US012378968B1

(12) United States Patent
Zhu

(10) Patent No.: US 12,378,968 B1
(45) Date of Patent: Aug. 5, 2025

(54) PORTABLE FAN AND FAN ASSEMBLY

(71) Applicant: Guangdong Aoyun Technology Co., Ltd., Guangdong (CN)

(72) Inventor: Xueping Zhu, Guangdong (CN)

(73) Assignee: Guangdong Aoyun Technology Co., Ltd., Huizhou (CN)

( * ) Notice: Subject to any disclaimer, the term of this patent is extended or adjusted under 35 U.S.C. 154(b) by 0 days.

(21) Appl. No.: 19/028,278

(22) Filed: Jan. 17, 2025

Related U.S. Application Data

(63) Continuation-in-part of application No. 18/420,163, filed on Jan. 23, 2024, now Pat. No. 12,264,689.

(51) Int. Cl.

| | |
|---|---|
| ***F04D 25/08*** | (2006.01) |
| ***F04D 19/00*** | (2006.01) |
| ***F04D 25/06*** | (2006.01) |
| ***F04D 29/64*** | (2006.01) |
| ***F04D 29/70*** | (2006.01) |

(52) U.S. Cl.
CPC ..... *F04D 25/08* (2013.01); *F04D 19/002* (2013.01); *F04D 25/0673* (2013.01); *F04D 29/646* (2013.01); *F04D 29/703* (2013.01)

(58) Field of Classification Search
CPC .. F04D 29/646; F04D 19/002; F04D 25/0673; F04D 29/522; F04D 29/644; F04D 25/0606; F04D 29/52; F04D 25/08; F04D 25/084; F21V 33/0096; F21Y 2115/10
See application file for complete search history.

(56) References Cited

U.S. PATENT DOCUMENTS

| | | | | |
|---|---|---|---|---|
| 4,516,561 | A * | 5/1985 | Stawski | F04D 25/08 126/25 B |
| 8,807,814 | B1 * | 8/2014 | Glenn | F21V 21/0885 362/580 |
| 2006/0073040 | A1 * | 4/2006 | Metzger | F04D 29/281 417/423.1 |
| 2008/0226476 | A1 * | 9/2008 | Lau | F04D 25/084 417/411 |
| 2009/0038108 | A1 * | 2/2009 | Shaanan | A47L 5/14 15/246 |
| 2014/0050600 | A1 * | 2/2014 | Kodato | A01G 20/47 417/360 |
| 2014/0093404 | A1 * | 4/2014 | Long | F04D 25/084 417/234 |
| 2020/0248700 | A1 * | 8/2020 | Potratz | F04D 29/281 |
| 2020/0309152 | A1 * | 10/2020 | Sanford | F04D 29/601 |
| 2023/0349391 | A1 * | 11/2023 | Rao | F04D 29/403 |

* cited by examiner

*Primary Examiner* — Bryan M Lettman
(74) *Attorney, Agent, or Firm* — Hemisphere Law, PLLC; Zhigang Ma

(57) ABSTRACT

A portable fan includes a housing body, a fan assembly, a power supply assembly and a first clamping device. The housing body is provided with an accommodating chamber, an air inlet, and an air outlet; the air outlet, at least part of the accommodating chamber and the air inlet are communicated to each other in sequence along a first preset direction. The fan assembly is located within the accommodating chamber and between the air inlet and the air outlet, and is configured to drive an air flow to flow from the air inlet to the air outlet. The power supply assembly is located within the accommodating chamber, the power supply assembly is offset from a projection of the fan assembly along the first preset direction, and the power supply assembly is electrically connected to the fan assembly to supply power to the fan assembly.

19 Claims, 21 Drawing Sheets

PORTABLE FAN AND FAN ASSEMBLY

CROSS-REFERENCE TO RELATED APPLICATIONS

This application is a Continuation-in-Part of the U.S. application Ser. No. 18/420,163 filed on Jan. 23, 2024, and entitled "PORTABLE FAN" now pending, the entire inventions of which are incorporated herein by reference.

TECHNICAL FIELD

The present invention relates to the field of fans, and in particular, to a portable fan and a fan assembly.

BACKGROUND

A fan is a household appliance that uses a motor to drive a fan blade to rotate to accelerate air circulation. The fan is mainly used for cooling and air circulation, and is widely used in places such as homes, classrooms, offices, shops, hospitals, and hotels. Traditional fans have a large volume and are inconvenient to carry. With the advancement of science, improved fans have smaller and smaller volumes. However, portable fans on the market still have shortcomings. For example, people cannot hold the fans at all times when working outdoors, which means that people cannot use the fans to blow air for cooling while working. Therefore, there is an urgent need for a portable fan on the market, which can free the hands during air blowing for cooling to bring users a more convenient and comfortable experience.

Furthermore, how to improve the wind efficiency of fans and enhance portability is also an important topic in the field of fans.

SUMMARY

In order to overcome the deficiencies of the prior art, the present invention provides a portable fan that can free the user's hands while cooling the user with blown air and is convenient for users to carry. The present invention also provides a fan assembly with relatively high wind efficiency, with the aim of improving the wind efficiency of the portable fan using the fan assembly.

In the first aspect, the present application provides a portable fan. The portable fan includes a housing body, a fan assembly, a power supply assembly and a first clamping device.

The housing body is provided with an accommodating chamber, an air inlet, and an air outlet; the air outlet, at least part of the accommodating chamber and the air inlet are communicated to each other in sequence along a first preset direction. The fan assembly is located within the accommodating chamber and between the air inlet and the air outlet, and is configured to drive an air flow to flow from the air inlet to the air outlet. The power supply assembly is located within the accommodating chamber, the power supply assembly is offset from a projection of the fan assembly along the first preset direction, and the power supply assembly is electrically connected to the fan assembly to supply power to the fan assembly. The first clamping device is connected to one side of the housing body, and is configured to form a clamping space with the housing body for clamping an external object, so as to fix the portable fan onto the external object.

In one embodiment, the housing body has a first side, a second side, and a third side; the first side and the second side are arranged opposite to each other; the air outlet is arranged on the first side, and the air inlet is arranged on the second side; the third side is located between the first side and the second side and is adjacent to both the first side and the second side; the first clamping device extends along the first preset direction and is connected to the third side of the housing body.

In one embodiment, the housing body further has a fourth side, a fifth side, and a sixth side; the fourth side and the third side are arranged opposite to each other, and the fifth side and the sixth side are arranged opposite to each other; a direction from the fifth side to the sixth side is a second preset direction, and the fan assembly and the power supply assembly are arranged in sequence along the second preset direction.

In one embodiment, the portable fan further includes a second clamping device, the second clamping device is connected to the fourth side of the housing body, and the second clamping device is further configured to form a clamping space with the housing body for clamping an external object, so as to fix the portable fan onto the external object; the first clamping device is connected to one end of the third side of the housing body adjacent to the air outlet, the second clamping device is connected to one end of the fourth side of the housing body adjacent to the air inlet, and the second clamping device extends in a direction opposite to that of the first clamping device.

In one embodiment, a direction from the third side to the fourth side is a third preset direction, and a maximum diameter of the housing body along the second preset direction is greater than a maximum diameter of the housing body along the third preset direction; a first hook is further arranged at one end of the fifth side of the housing body adjacent to the air outlet, and both ends of the first hook are connected to the fifth side of the housing body and form a first hook hole with the housing body; a second hook is further arranged at one end of the sixth side of the housing body adjacent to the air outlet, and both ends of the second hook are connected to the sixth side of the housing body and form a second hook hole with the housing body.

In one embodiment, the fan assembly is provided with at least one first snap-fit member, at least one second snap-fit member is arranged on an inner side of the housing body, and the at least one first snap-fit member cooperates with the at least one second snap-fit member, so that the fan assembly is fixed within the accommodating chamber of the housing body; the number of the at least one first snap-fit member is multiple, the number of the at least one second snap-fit member is also multiple, and multiple first snap-fit members are respectively arranged on both sides of the fan assembly; the first snap-fit member is one of a protrusion and a groove, and the second snap-fit member is the other one of the protrusion and the groove; the protrusion includes a latching hook portion.

In one embodiment, the fan assembly includes a motor, a fan blade and an output shaft; the fan blade is mounted on the output shaft, the fan assembly is an axial flow fan assembly, and the output shaft is arranged along the first preset direction.

In one embodiment, the fan assembly further includes a fan shell, the fan shell includes a shell main body, an air outlet hood, and a grille; the motor and the fan blade are arranged within the shell main body; the air outlet hood is arranged on one side of the shell main body and has a plurality of air outlet holes, and the air outlet hood is also located at the air outlet; the grille is arranged on the other side of the shell main body; the air outlet hood includes a plurality of air gathering rings and an annular wall structure connected to a periphery of the plurality of air gathering rings; the grille includes a plurality of air inlet holes; a plurality of air outlet holes are defined among the plurality of air gathering rings, and the air gathering rings are configured to cooperate with an inner side surface of the annular wall structure to pressurize wind from the shell main body and then blow it out.

In one embodiment, the inner side surface of the annular wall structure is an inclined surface or an arc-shaped surface, so that an inner diameter of the annular wall structure gradually decreases along the first preset direction; the grille is a metal barrier net, the metal barrier net is provided with a plurality of air inlet holes, and an inner diameter of each air inlet hole ranges from 0.5 mm to 4 mm.

In one embodiment, the air inlet hole is in a regular hexagon shape, a surrounding wall is arranged between two adjacent air inlet holes, and a width of the surrounding wall ranges from 0.05 mm to 2 mm.

In one embodiment, the air outlet hood further includes a mounting structure connected to the plurality of air gathering rings; the mounting structure includes an annular mounting wall, a cover plate connected to the annular mounting wall and a first mounting post connected to an inner side of the cover plate, and the first mounting post is configured to be mounted corresponding to a mounting hole of the shell main body; the cover plate is positioned in the middle of the plurality of air outlet holes, an outer surface of the cover plate is provided with a groove, the mounting structure is further provided with a first alignment structure, the shell main body has a second alignment structure, and the first alignment structure and the second alignment structure cooperate to enable an aligned assembly of the shell main body and the air outlet hood.

In one embodiment, the shell main body includes a cylindrical arranged sidewall structure, a mounting part located at one end inside the sidewall structure and an air guide part connected between the mounting part and the sidewall structure, the air guide part includes a plurality of air guide blades arranged at intervals and is configured to guide wind from the fan blade based on a preset direction, the fan blade and the motor are arranged within the sidewall structure on one side of the mounting part, and the motor is mounted on the mounting part; the mounting part is provided with an opening, a conducting wire connected to the motor passes through the opening and then extends from a gap between the shell main body and the air outlet hood to be connected with a control assembly.

In one embodiment, the mounting part is provided with a blind hole arranged facing the motor, an opening of the blind hole faces a side where the motor is located, and the blind hole is configured to store lubricating oil required for a rotation of the output shaft; the mounting part includes a mounting plate and a second mounting post connected to the mounting plate and extending towards the grille, and the blind hole is arranged on the second mounting post; the motor has a motor mounting hole, and the motor mounting hole is sleeved on the second mounting post, thereby the motor is mounted on the second mounting post; a fixing post with a through hole as well as a limiting ring is also arranged within the blind hole, the output shaft passes through the fixing post and the limiting ring, and a limiting part is located at one end of the limiting ring away from the fixing post; the output shaft includes a main body connected to the fan blade and a limiting part connected to the main body; the limiting part includes a rod part and a limiting end connected to one end of the rod part away from the fan blade; a diameter of the limiting end gradually decreases in a direction away from the blade; an outer surface of the rod part, together with the limiting end and the main body, encloses a limiting groove; the limiting ring has a limiting hole, a diameter of the limiting hole is greater than that of the rod part and less than that of the main body and that of the limiting end, so that the limiting ring is limited within the limiting groove.

In one embodiment, the fan shell further includes an air inlet cover, the grille is mounted on an inner side of the air inlet cover, the air inlet cover is arranged on one end of the shell main body away from the air outlet hood, the air inlet cover is in an annular shape, and the air inlet cover is sleeved on one end of the shell main body; an outer side surface of one end of the shell main body can be provided with a stepped groove, the air inlet cover is sleeved on the stepped groove, and an outer side surface of the air inlet cover is flush with the outer side surface of the shell main body.

In one embodiment, the housing body includes a first portion and a second portion, the first portion and the second portion are arranged in sequence along the second preset direction; a plurality of first clamping members are arranged at an edge of the first portion, and a plurality of second clamping members are arranged at an edge of the second portion; the plurality of first clamping members and the plurality of second clamping members are snap-fitted together to connect the first portion and the second portion into a single entity.

In one embodiment, the housing body includes a first portion, a second portion, and a mounting shell; the first portion, the mounting shell, and the second portion are arranged in sequence along the second preset direction; a plurality of first clamping members are arranged at an edge of the first portion, and a plurality of second clamping members are arranged at an edge of the second portion; the mounting shell is provided with a plurality of third clamping members that are snap-fitted with the plurality of first clamping members, and a plurality of fourth clamping members that are snap-fitted with the plurality of second clamping members, so that the mounting shell, the first portion and the second portion are connected into a single entity.

In one embodiment, an inner side of the housing body is provided with a plurality of air guide plates corresponding to the air inlet, and the plurality of air guide plates are located between the air inlet and the fan assembly; each air guide plate extends along the first preset direction, and the plurality of air guide plates are arranged in sequence along a direction from the third side to the fourth side.

In one embodiment, the housing body includes a housing and a mounting shell located within the housing; the mounting shell includes a partition plate, and the fan assembly and the power supply assembly are respectively positioned on two sides of the partition plate; the first clamping device is connected to the mounting shell and is integrally formed with the mounting shell; the housing is provided with a clamping slot, and a part of the first clamping device connecting to the mounting shell is fixed within the clamping slot.

In one embodiment, the power supply assembly includes a battery; the mounting shell further includes at least one limiting and fixing member connected to the partition plate and extending towards the battery, and the at least one limiting and fixing member is arranged around a periphery of the battery to fix the battery; the portable fan further includes a control assembly, the control assembly is located within the accommodating chamber, and the control assembly includes a control button and a circuit board electrically connected to the control button and the battery; the third side of the housing body is provided with a button hole, and the control button is arranged corresponding to the button hole.

In the second aspect, the present application provides a fan assembly. The fan assembly includes a fan shell, a motor and a fan blade.

The fan blade is connected to the motor.

The fan blade is arranged within the fan shell; the fan shell includes a shell main body, an air outlet hood, and a grille; the air outlet hood is arranged on one side of the shell main body and has a plurality of air outlet holes, the grille is arranged on the other side of the shell main body, and the grille includes a plurality of air inlet holes for reducing wind resistance and increasing air intake volume; the air outlet hood includes a plurality of air gathering rings and an annular wall structure connected to a periphery of the plurality of air gathering rings; a plurality of air outlet holes are defined among the plurality of air gathering rings, and the air gathering rings are configured to cooperate with an inner side surface of the annular wall structure to pressurize wind from the shell main body and then blow it out.

The present invention has the following beneficial effects. In the portable fan of the present invention, by arranging the power supply assembly to be offset from the projection of the fan assembly along the first preset direction, the fan assembly and the power supply assembly can be arranged side-by-side in the accommodating chamber of the housing body. This makes the position layout of the fan assembly and the power supply assembly in the housing body more reasonable and compact, which is beneficial to the miniaturization of the portable fan and increases its portability. Moreover, the air path formed by the fan assembly can also be offset from the power supply assembly, avoiding the power supply assembly affecting the air-flow efficiency of the fan assembly. As a result, the portable fan has a higher air-flow efficiency, stronger wind power, and better cooling effect.

BRIEF DESCRIPTION OF THE DRAWINGS

In order to explain the technical solutions of the embodiments of the present invention more clearly, the following will briefly introduce the accompanying drawings used in the embodiments. The drawings in the following description are only some embodiments of the present invention. Those of ordinary skill in the art can obtain other drawings based on these drawings without creative work.

The present invention is further described below in detail in combination with the accompanying drawings and embodiments.

DETAILED DESCRIPTION OF THE EMBODIMENTS

Figure 1:
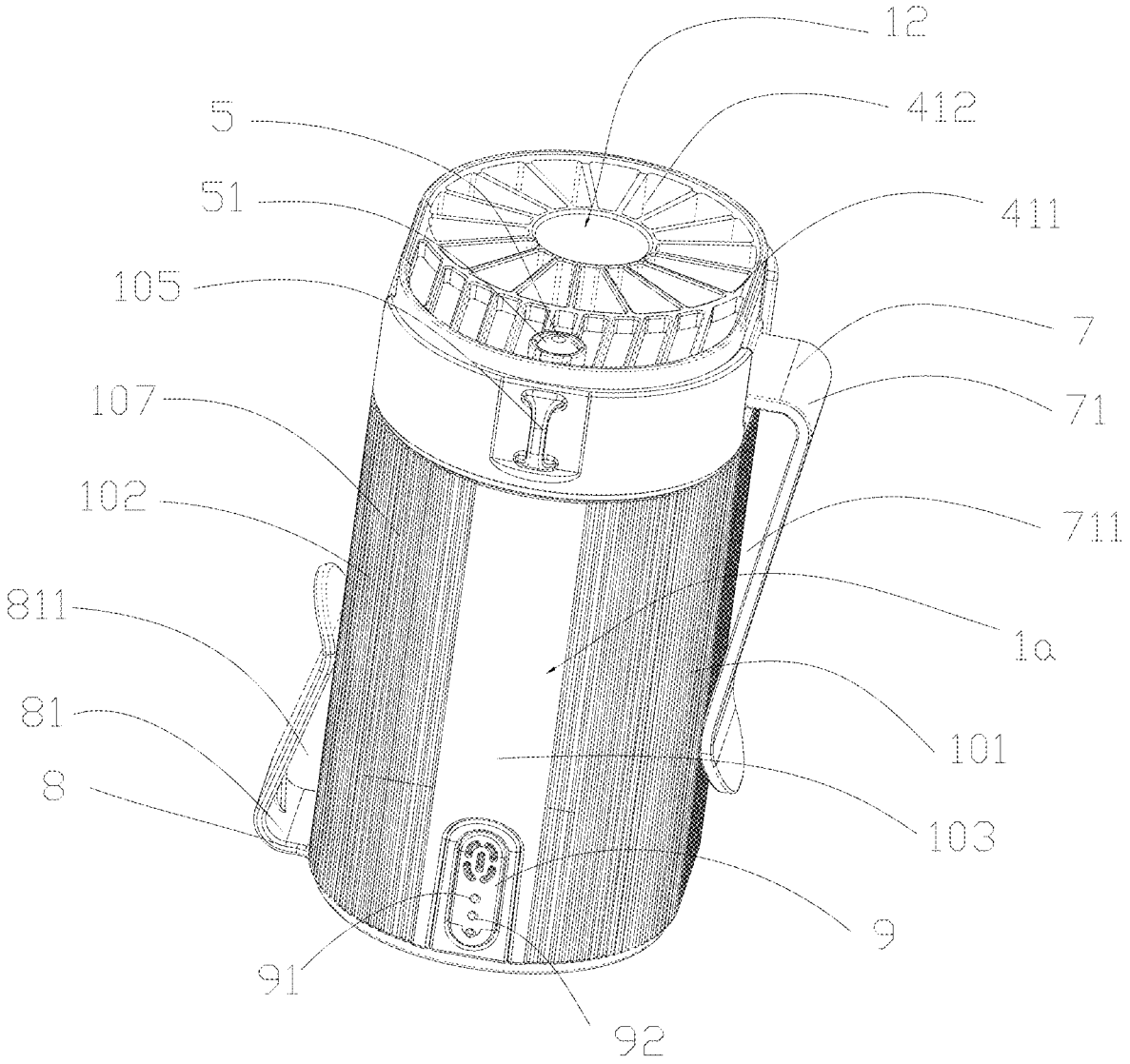
FIG. 1 is a perspective view of a portable fan according to Embodiment I of the present invention.

Referring to FIG. 1 to FIG. 5, a portable fan includes a housing 1, a fan assembly 2 a power supply assembly 3 and a mounting shell 4. The housing 1 is provided with a first air inlet 11, an air outlet 12, and a first air guide chamber 13; the first air inlet 11, the first air guide chamber 13, and the air outlet 12 are communicated to each other in sequence. The fan assembly 2 is configured to drive an air flow to flow from the first air inlet 11 to the air outlet 12. The power supply assembly 3 is electrically connected to the fan assembly 2 to supply power to the fan assembly 2. The mounting shell 4 is connected to the housing 1; the mounting shell 4 includes a first mounting part 41 and a second mounting part 42; the first mounting part 41 is integrally formed with the second mounting part 42; the first mounting part 41 is configured to mount the fan assembly 2; and the second mounting part 42 is configured to mount the power supply assembly 3. Through the above structure, when a user turns on the fan, with the support of the power of the power supply assembly 3, the fan assembly 2 extracts air from the first air inlet 11 and blows the air to a human body through the first air guide chamber 13 and the air outlet 12. This design is simple and efficient and can improve the air blowing efficiency. Moreover, due to an integrated design of the mounting shell 4 for mounting the power supply assembly 3 and the fan assembly 2, the internal structure of the fan is stable. This greatly reduces the manufacturing cost during manufacturing and production and can achieve mass production of the portable fan, and the production efficiency is greatly improved.

In this implementation, the portable fan further includes a lighting device 5. The power supply assembly 3 is electrically connected to the lighting device 5 to supply power to the lighting device 5. Specifically, the lighting device 5 includes an LED lamp 51, and a mounting slot 52 is arranged at an upper end of the mounting shell 4; and the LED lamp 51 is located inside the mounting slot 52. Through the above structure, the portable fan has a lighting function. The user can enjoy both the air blowing function and the lighting function of the fan when working outside at hot summer night. The LED lamp is used for lighting when the user searches for items or in an emergency situation, thereby improving the multifunctionality of the portable fan and improving the user experience.

In this implementation, an upper end of the first mounting part 41 is provided with an air outlet hood 411; the air outlet hood 411 is connected to an upper end of the housing 1; the air outlet hood 411 is provided with several air outlet holes 412; and the air outlet holes 412 are communicated to the air outlet 12. Further, the first mounting part 41 is provided with a second air guide chamber 413 and a second air inlet 414; and the second air inlet 414, the second air guide chamber 413, and the air outlet holes 412 are communicated to each other in sequence. Specifically, the fan assembly 2 is arranged inside the second air guide chamber 413; the fan assembly 2 is configured to drive air to pass through the first air inlet 11, the first air guide chamber 13, the second air inlet 414, the second air guide chamber 413, and the air outlet holes 412 in sequence to form a blowing air flow. Through the above structure, it is effectively achieved that the fan assembly 2 drives the air to enter from the first air inlet 11 of the housing 1 and then the second air inlet 414 of the first mounting part 41 through the first air guide chamber 13 of the housing 1, and the air is finally blown out of the housing 1 through the air outlet holes 412 and the air outlet 12 via the second air guide chamber 413. This design makes the air inlet and the air outlet in the same direction, greatly improves the air blowing efficiency of the fan, and improves the usability of the portable fan.

In this implementation, the fan assembly 2 includes a motor 21 and a fan blade 22; the motor 21 has an output shaft 23; and the fan blade 22 sleeves the output shaft 23. Through the above structure, the motor 21 drives the fan blade 22 to rotate, and the output shaft 23 drives the fan blade 22 to extract the air and blow the air to the human body, which effectively achieves the air blowing function of the fan and improves the air blowing efficiency.

In this implementation, the portable fan further includes an air inlet hood 6, wherein the air inlet hood 6 is connected to a lower end of the housing 1; the air inlet hood 6 is provided with several air inlet holes 61; and the air inlet holes 61 are communicated to the first air inlet 11. Through the above structure, the design of the air inlet hood 6 is conducive to preventing other debris, such as hairs and paper scraps, from being sucked into the fan, which is conducive to maintaining the safety of the fan.

In this implementation, a spacer device 43 is arranged between the first mounting part 41 and the second mounting part 42, and the spacer device 43 is composed of several uniformly distributed partition plates 431. Through the above structure, due to the arrangement of the several uniformly distributed partition plates 431, and due to the fact that the first mounting part 41 is provided with the fan assembly 2 and the second mounting part 42 is provided with the power supply assembly 3, there is a certain space between the fan assembly 2 and the power supply assembly 3, which can prevent heat generated by the battery in the power supply assembly 3 from affecting the fan assembly 2 and help to prolong the service life of the fan.

In this embodiment, a second mounting part 42 is provided with a mounting chamber 421; a power supply assembly 3 includes a battery 32; the portable fan further includes a circuit board 31, the circuit board 31 is electrically connected to the battery 32; and both the circuit board 31 and the battery 32 are arranged in a mounting chamber 421. Through the above structure, since both the circuit board 31 and the battery 32 are arranged in the mounting chamber 421, it is beneficial to make the structure compact, reduce the mounting space and the production cost, and facilitate the user to carry the portable fan. The second mounting part 42 includes an arc-shaped partition plate 441 and connecting plates 442 connected to both sides of the partition plate 441. The partition plate 441 and the two connecting plates 442 enclose the mounting chamber 421. A spacer device 43 is arranged on the side of the partition plate 441 adjacent to the mounting chamber 421.

In this implementation, an upper part of the housing 1 is provided with a clamping slot 14; the first mounting part 41 is provided with a limiting protrusion 415; and the limiting protrusion 415 presses against the clamping slot 14, so that the mounting shell 4 is partially located inside the first air guide chamber 13. Through the above structure, the first mounting part 41 can be clamped and sleeved inside the housing 1, and the air outlet hood 411 can expose the air outlet 12, which is convenient for the fan to blow out the air and improves the user experience.

In this implementation, the housing 1 includes a front panel 101, a rear panel 102 opposite to the front panel 101, and a left panel 103 and a right panel 104 which are connected to the front panel 101 and the rear panel 102; and the front panel 101, the rear panel 102, the left panel 103, and the right panel 104 are encircled to form the first air guide chamber 13.

In this implementation, the first mounting part 41 is connected to a first clamping device 7; and the first clamping device 7 is configured to clamp the portable fan onto clothes of a user. Specifically, the first clamping device 7 is a first clip 71; and the first clip 71 presses against the front panel 101 to form a first clamping space 711 between the first clip 71 and the front panel 101. The first clip 71 can be a metal or plastic clip. Through the above structure, during use, the user can clamp the fan at the waist of pants or a pocket of clothes through the first clip 71, so that the fan blows air into the body of the user. Compared to a traditional small handheld fan, the fan with the clip can free the hands. When working, the user can feel the air blown out from the fan without holding the fan, thus achieving a cool experience. This greatly improves the portability and practicality of the product.

In this implementation, the air inlet hood 6 is connected to a second clamping device 8; and the second clamping device 8 is configured to clamp the portable fan onto clothes of a user. Specifically, the second clamping device 8 is a second clip 81; and the second clip 81 presses against the rear panel 102 to form a second clamping space 811 between the second clip 81 and the rear panel 102. The second clip 81 can be a metal or plastic clip. Through the above structure, during use, after clamping the portable fan to the waist of pants with the first clip 71, the user can clamp the second clip 81 to a hem, thereby achieving an effect of stabilizing the fan. When the user needs to do large body movements due to work, the fan can still be firmly fixed at the waist of the pants, which greatly ensures the stability of the fan.

In this implementation, a surface of the housing 1 is further provided with a first hook 105 and a second hook 106; a first hook hole 1051 is formed between the first hook 105 and the left panel 103; and a second hook hole 1061 is formed between the second hook 106 and the right panel 104. Through the above structure, when it is inconvenient for the user to clamp the fan onto the clothes, the user can thread a rope through the first hook hole 1051 and the second hook hole 1061, and then hang the rope around the neck, so that the fan can be carried without being held by the hands, and the portability of the fan is improved.

In this implementation, the housing 1 is further provided with an on/off button 9; the on/off button 9 is electrically connected to the air blowing assembly 2 and the power supply assembly 3; the air inlet hood 6 is connected to a button mounting part 62; the button mounting part 62 is provided with a button mounting hole 621; the on/off button 9 is located at the button mounting hole 621; the lower end of the housing 1 is provided with a first mounting port 15, an inwards protruding button mounting slot 16, and a second mounting port 17; the button mounting part 62 can be clamped into the button mounting slot 16; the first mounting port 15, the button mounting hole 621, the button mounting slot 16, and the second mounting port 17 are communicated to each other in sequence; and the on/off button 9 is further provided with a fan gear indicator lamp 91 and a charging indicator lamp 92. Through the above structure, the user can press the on/off button 9 to turn on the fan. The fan gear indicator lamp 91 and the charging indicator lamp 92 are included. This design is simple and ingenious, making it convenient for the use to use.

In this implementation, the air inlet hood 6 is provided with a charging interface 63 for charging the battery 32, and the charging interface 63 includes a DC charging interface or a Type-C charging interface. Through the above structure, the DC charging interface or the Type-C charging interface can adapt to requirements of different users for charging interfaces, making it convenient for the user to charge the fan in a timely manner.

In this implementation, the mounting shell 4 is connected to the housing 1 through a buckle; the air inlet hood 6 is connected to the housing 1 through a buckle; and an outer wall of the housing 1 is provided with several anti-slip convex bars 107. Through the above structure, the structure of the fan is mounted more stably and firmly through the buckle connection, so that the quality and safety of the product are improved. Furthermore, the outer wall of the housing 1 of the fan is provided with the several anti-slip convex bars 107, so that a friction force can be increased when the fan is clamped at the waist of the pants, and the fan can be prevented from easily falling off.

It can be understood that, as shown in FIG. 1 to FIG. 5, a housing 1 and a mounting shell 4 jointly form a housing body 1*a* of the portable fan. The housing body 1*a* has an accommodating chamber 1*b* for accommodating the power supply assembly 3, the fan assembly 2, etc., a first air inlet 11, and an air outlet 12.

The accommodating chamber 1*b* includes a first air guide chamber 13. The air outlet 12, at least part of the accommodating chamber (the first air guide chamber 13) and the first air inlet 11 are communicated to each other in sequence along a first preset direction X-X.

The fan assembly 2 is located above the first air guide chamber 13 within the accommodating chamber 1*b* and between the first air inlet 11 and the air outlet 12, and is configured to drive an air flow to flow from the first air inlet 11 to the air outlet 12.

The power supply assembly 3 is located within the accommodating chamber 1*b*. The power supply assembly 3 includes the battery 32, and the battery 32 is offset from a projection of the fan assembly 2 along the first preset direction X-X. The power supply assembly 3 is electrically connected to the fan assembly 2 to supply power to the fan assembly 2.

A first clamping device is connected to one side of the housing body (such as the mounting shell 4), and is configured to form a clamping space with the housing body 1*a* for clamping an external object (such as belts, pockets, backpacks, and tablets or objects with sheet-like or plate-like structures), so as to fix the portable fan onto the external object.

It can be understood that by arranging the power supply assembly 3 to be offset from the projection of the fan assembly 2 along the first preset direction X-X, the fan assembly and the power supply assembly can be arranged side-by-side in the accommodating chamber of the housing body. This makes the position layout of the fan assembly and the power supply assembly in the housing body more reasonable and compact, which is beneficial to the miniaturization of the portable fan and increases its portability. Moreover, the air path formed by the fan assembly can also be offset from the power supply assembly, avoiding the power supply assembly affecting the air-flow efficiency of the fan assembly. As a result, the portable fan has a higher air-flow efficiency, stronger wind power, and better cooling effect.

Specifically, the housing body 1*a* has a first side 111, a second side 112, a third side 113, a fourth side 114, a fifth side 115, and a sixth side 116.

The first side 111 and the second side 112 are arranged opposite to each other; the air outlet 12 is arranged on the first side 111, and the first air inlet 11 is arranged on the second side 112; the third side 113 is located between the first side 111 and the second side 112 and is adjacent to both the first side 111 and the second side 112. In this embodiment, the first clamping device 7 extends along the first preset direction X-X and is connected to the third side 113 of the housing body 1*a*. It can be understood that by arranging the first clamping device 7 on the third side 113, the problem of air intake and exhaust being affected when it is arranged on the first side or the second side can be avoided, effectively ensuring the air-flow efficiency.

The fourth side 114 and the third side 113 are arranged opposite to each other, and the fifth side 115 and the sixth side 116 are arranged opposite to each other; a direction from the fifth side 115 to the sixth side 116 is a second preset direction Y-Y, and the fan assembly 2 and the power supply assembly 3 are arranged in sequence along the second preset direction Y-Y. It can be understood that arranging the fan assembly 2 and the power supply assembly 3 in sequence along the second preset direction Y-Y, and arranging the first clamping device 7 on the third side 113, results in a reasonable overall layout of the portable fan. This design avoids the problem of the first clamping device 7 increasing the length of the portable fan in the second preset direction Y-Y.

A the second clamping device 8 is connected to the fourth side 114 of the housing body 1*a*, and the second clamping device 8 is further configured to form a clamping space with the housing body 1*a* for clamping an external object, so as to fix the portable fan onto the external object. Moreover, the first clamping device 7 is connected to one end of the third side 113 of the housing body 1*a* adjacent to the air outlet 12, the second clamping device 8 is connected to one end of the fourth side 114 of the housing body 1*a* adjacent to the first air inlet 11, and the second clamping device 8 extends in a direction opposite to that of the first clamping device 7. It can be understood that the first clamping device 7 and the second clamping device 8 are respectively arranged on the third side 113 and the fourth side 114. Users can select one of the clamping devices according to their needs. In addition, since the first clamping device 7 and the second clamping device 8 extend in opposite directions, it also facilitates users to clamp the portable fan either upwards or downwards onto different external objects.

Furthermore, a direction from the third side 113 to the fourth side 114 is a third preset direction Z-Z, and a maximum diameter of the housing body 1*a* along the second preset direction Y-Y is greater than a maximum diameter of the housing body 1*aa* long the third preset direction Z-Z. A first hook 105 is arranged at one end of the fifth side 115 of the housing body 1*a* adjacent to the air outlet 12, and both ends of the first hook 105 are connected to the fifth side 115 of the housing body 1*a* and form a first hook hole 1051 with the housing body 1*a*. A second hook 106 is arranged at one end of the sixth side 116 of the housing body 1*a* adjacent to the air outlet 12, and both ends of the second hook 106 are connected to the sixth side 116 of the housing body 1*a* and form a second hook hole 1061 with the housing body 1*a*.

Furthermore, in this embodiment, the height of the first mounting part 41 along the first preset direction X-X is less than that of the partition plate 441 along the first preset direction X-X. This enables the partition plate 441 to block the wind from the first air inlet 11 from entering the side where the power supply assembly 3 is located, thereby improving the air-flow efficiency of the portable fan. Moreover, the overall weight of the portable fan can be relatively light. However, it can be understood that in an alternative embodiment, the height of the first mounting part 41 along the first preset direction X-X can also be basically equal to that of the partition plate 441 along the first preset direction X-X.

Figure 2:
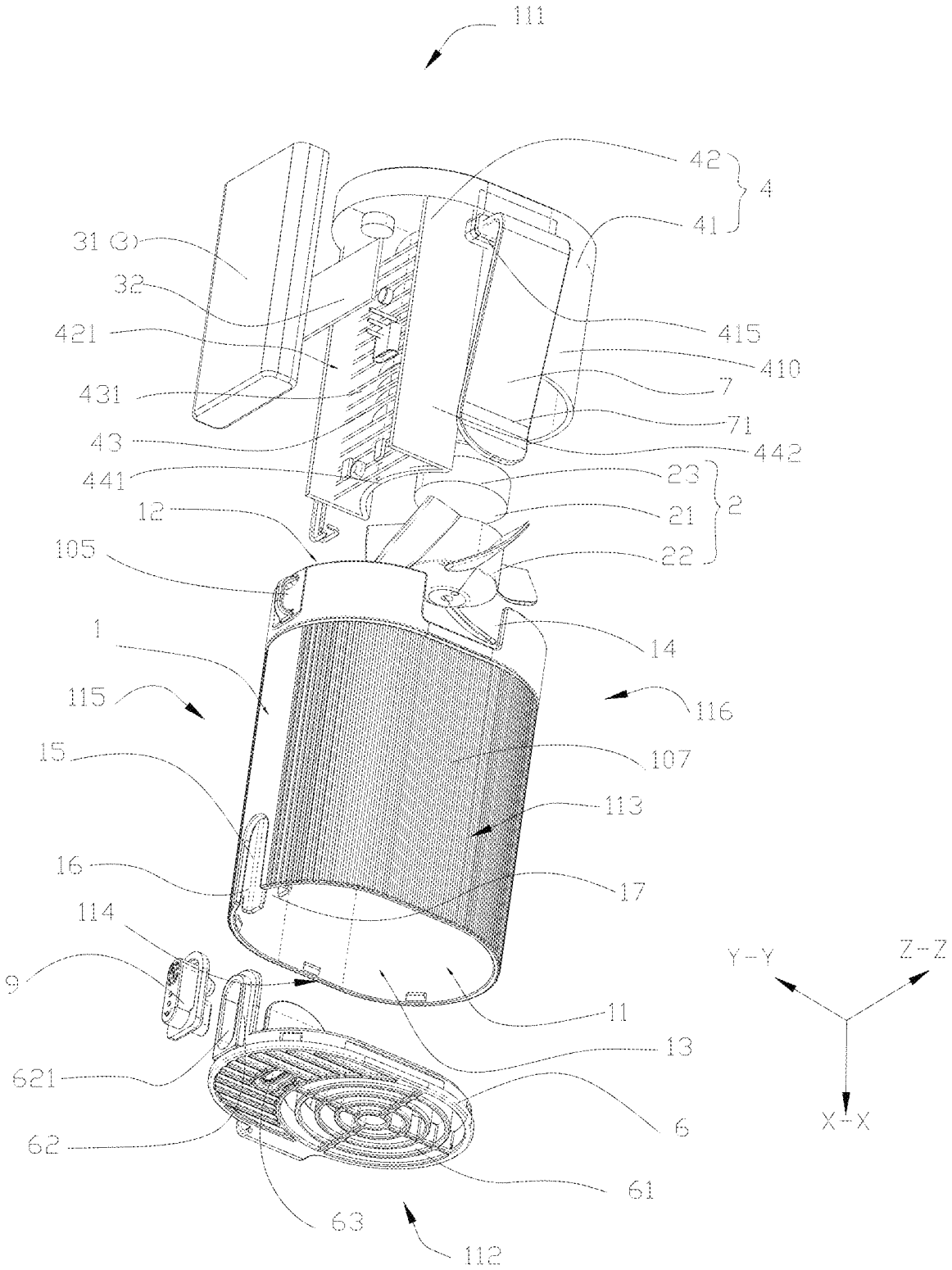
FIG. 2 is an exploded view of the portable fan shown in FIG. 1.
Figure 3:
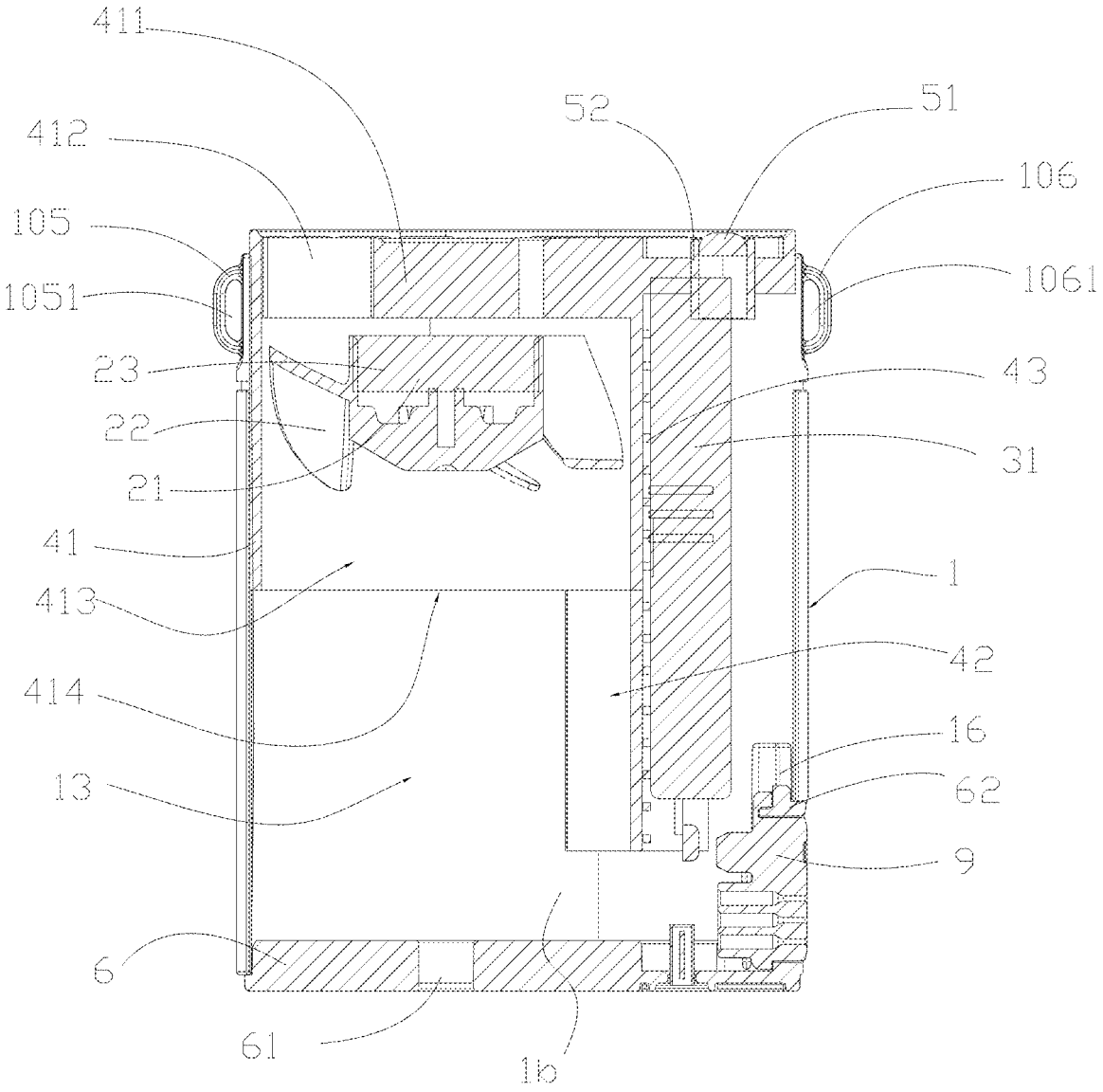
FIG. 3 is a cross-sectional view of the portable fan shown in FIG. 1.
Figure 4:
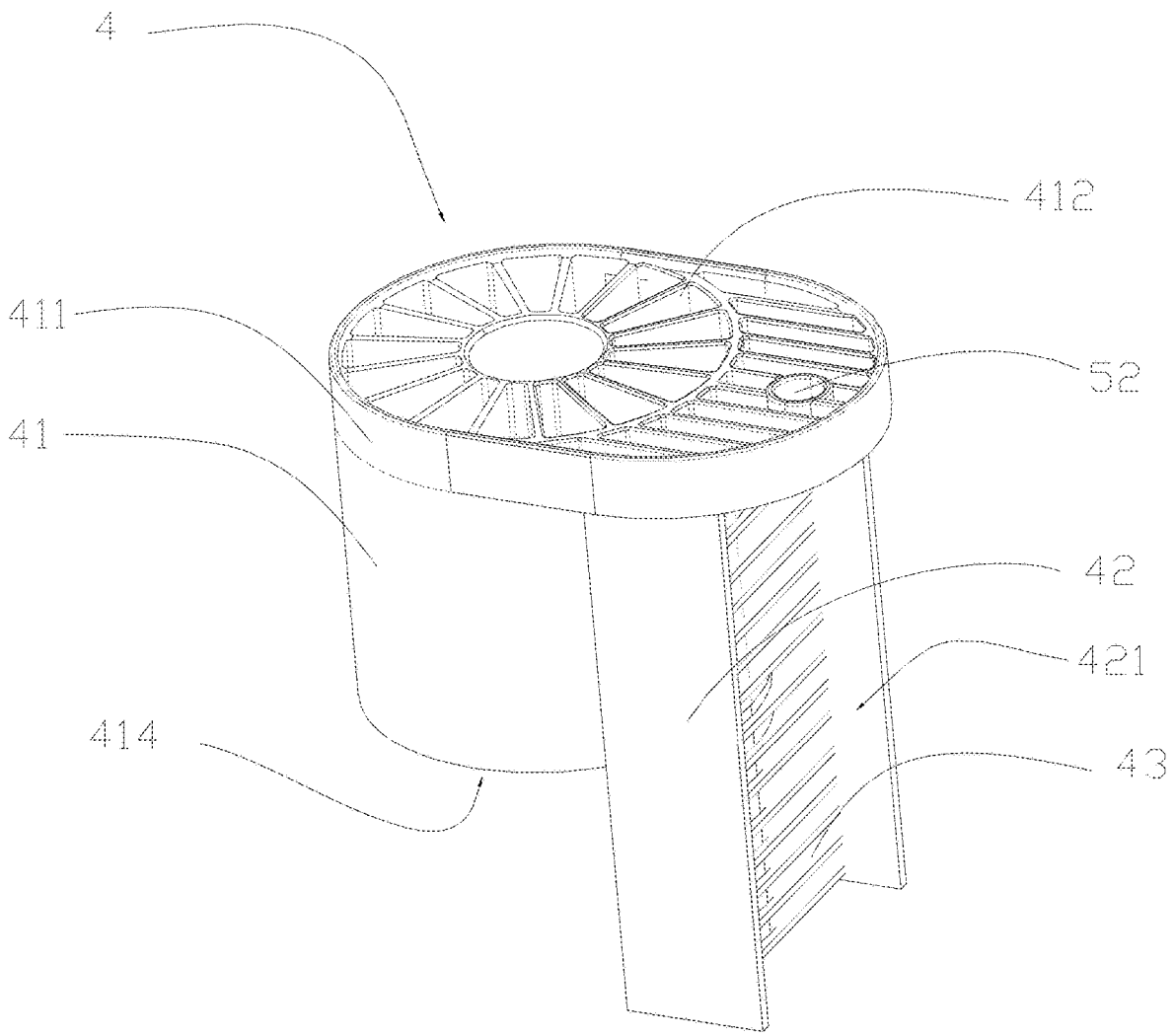
FIG. 4 is a schematic diagram of a mounting shell of the portable fan shown in FIG. 1.
Figure 5:
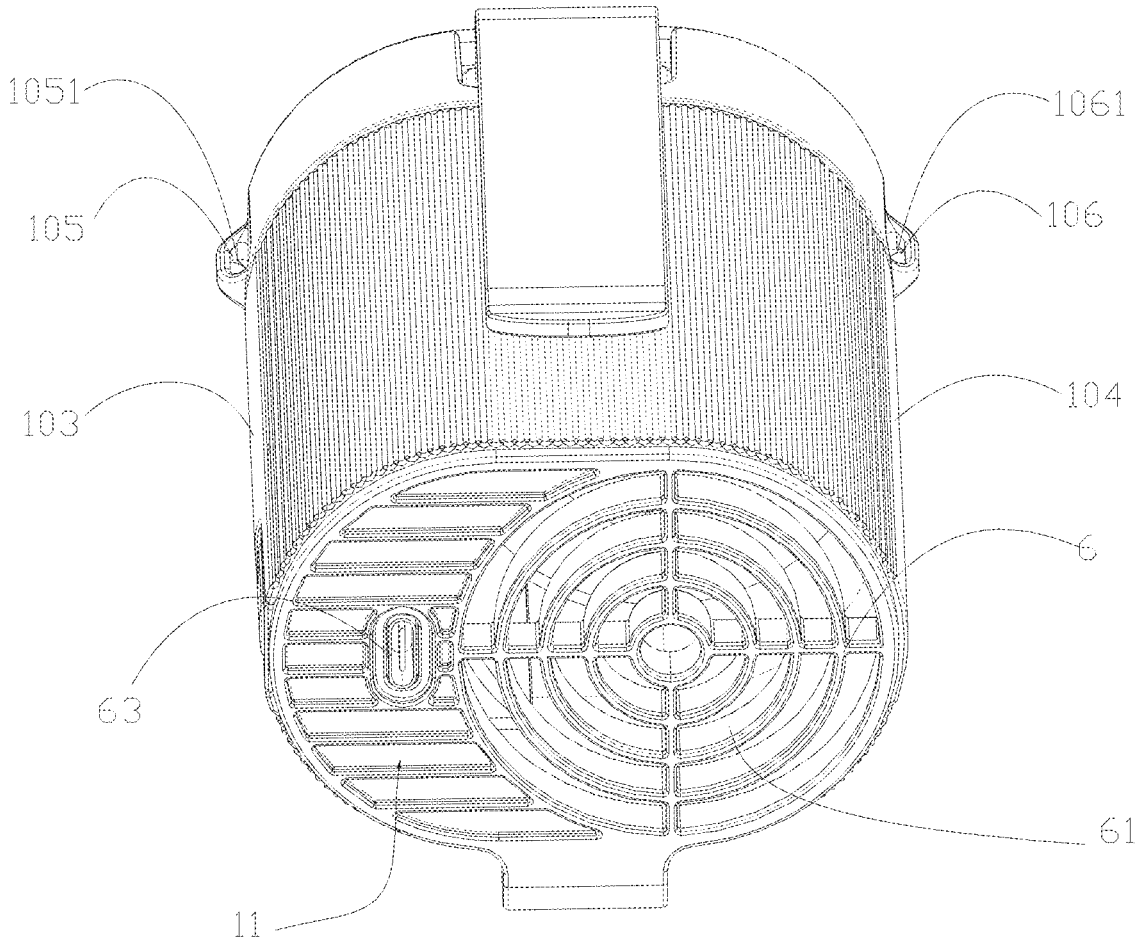
FIG. 5 is a perspective view from another angle of the portable fan shown in FIG. 1.
Figure 6:
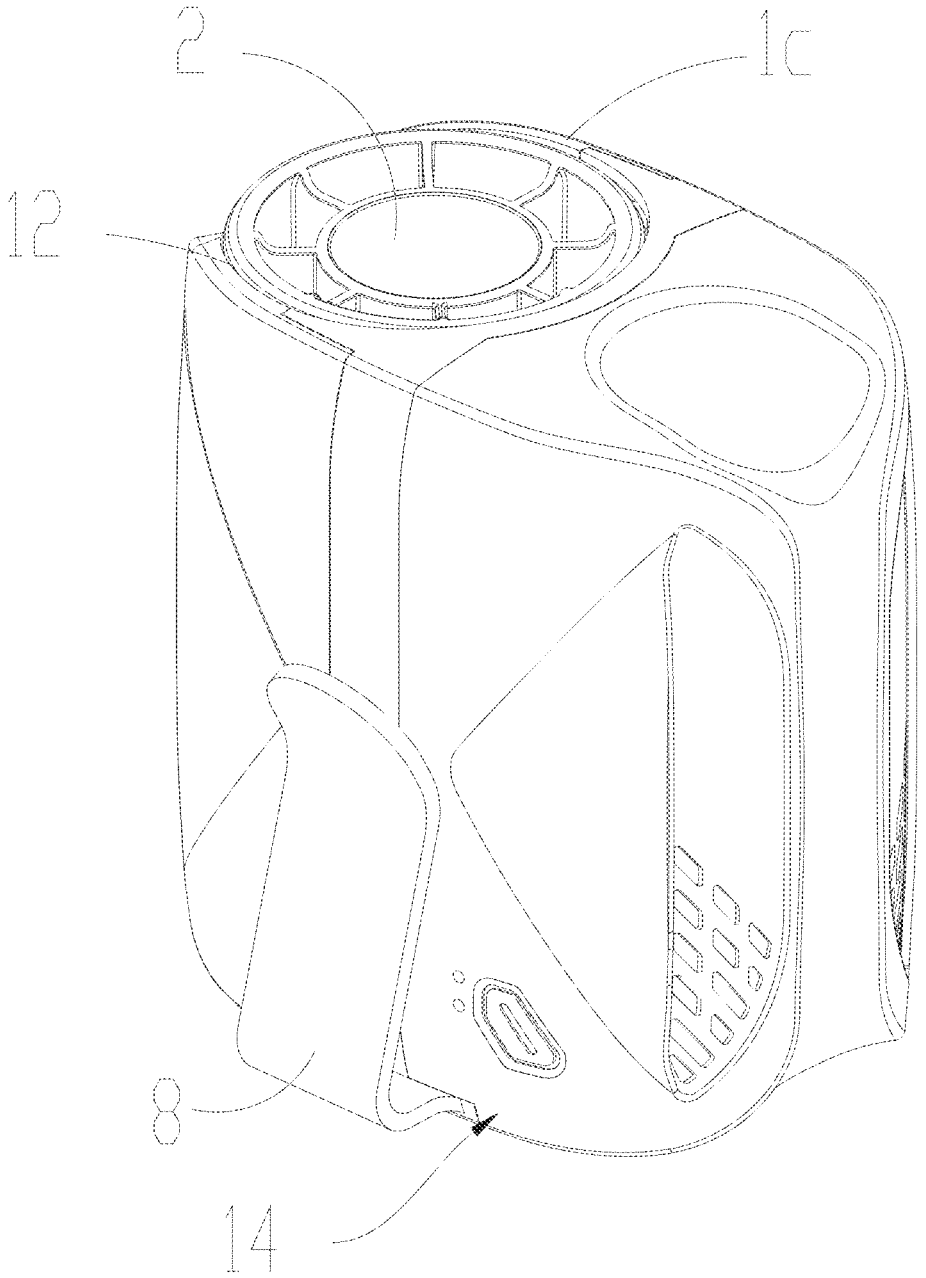
FIG. 6 is a perspective view of the portable fan according to Embodiment II of the present invention.
Figure 7:
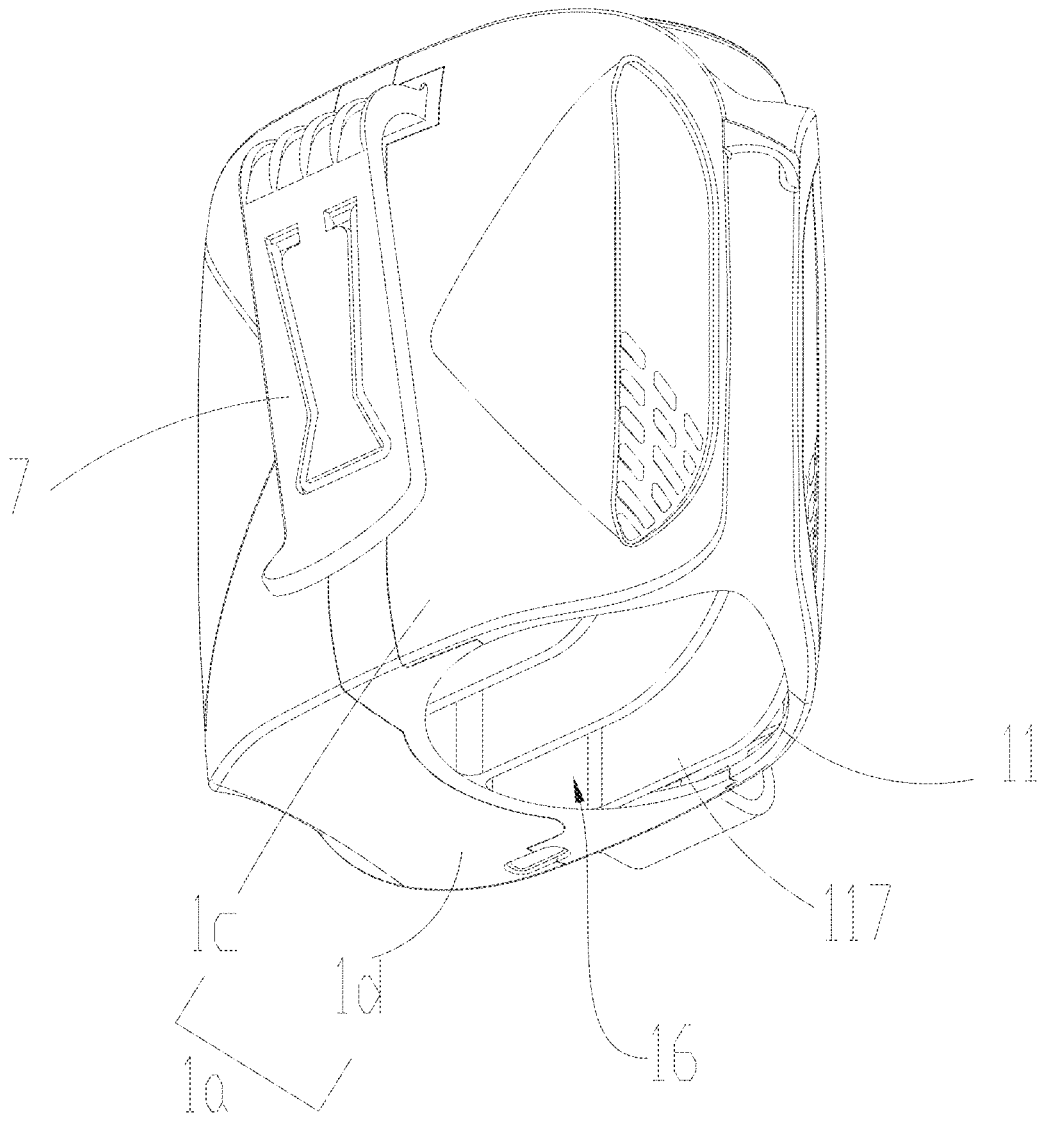
FIG. 7 is a perspective view from another angle of the portable fan shown in FIG. 6.
Figure 8:
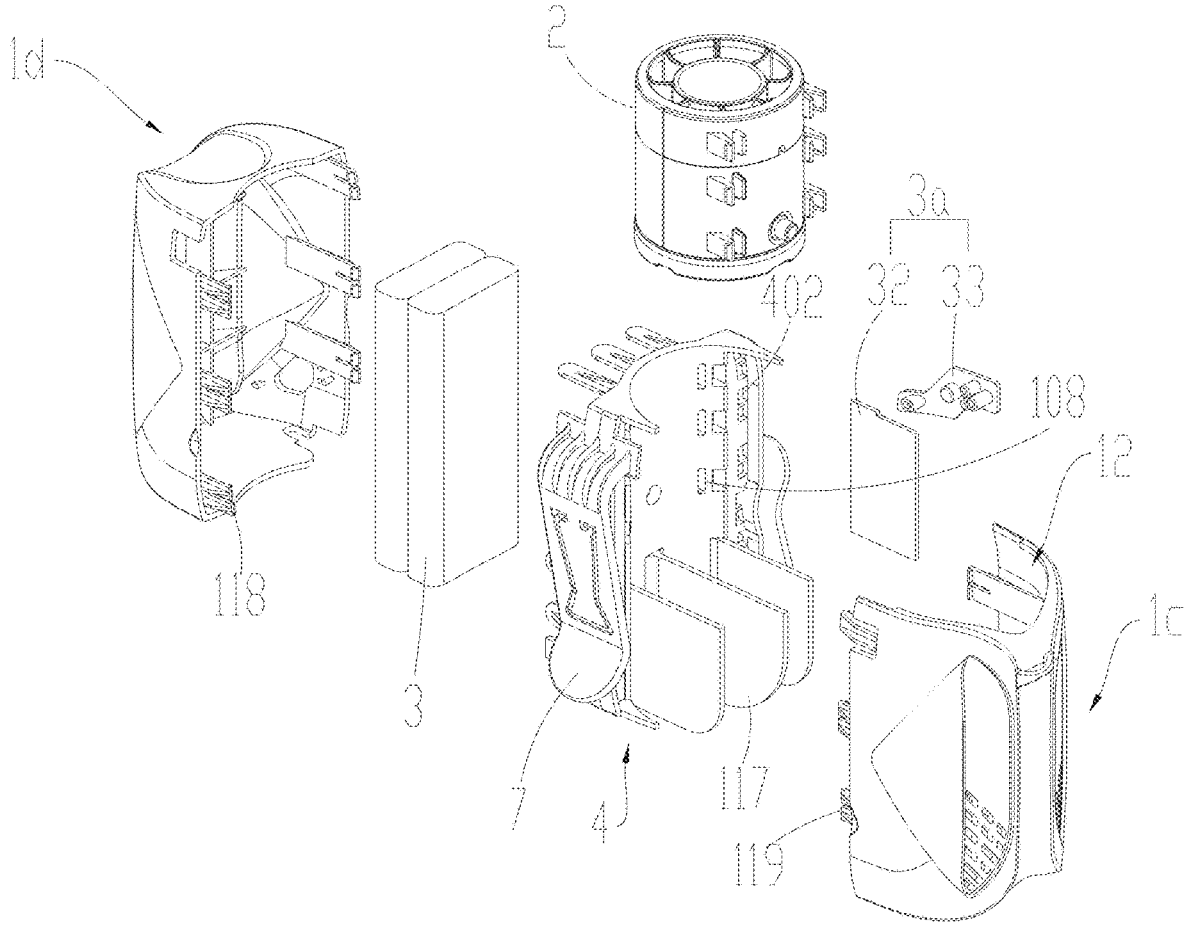
FIG. 8 is an exploded view of the portable fan shown in FIG. 6.
Figure 9:
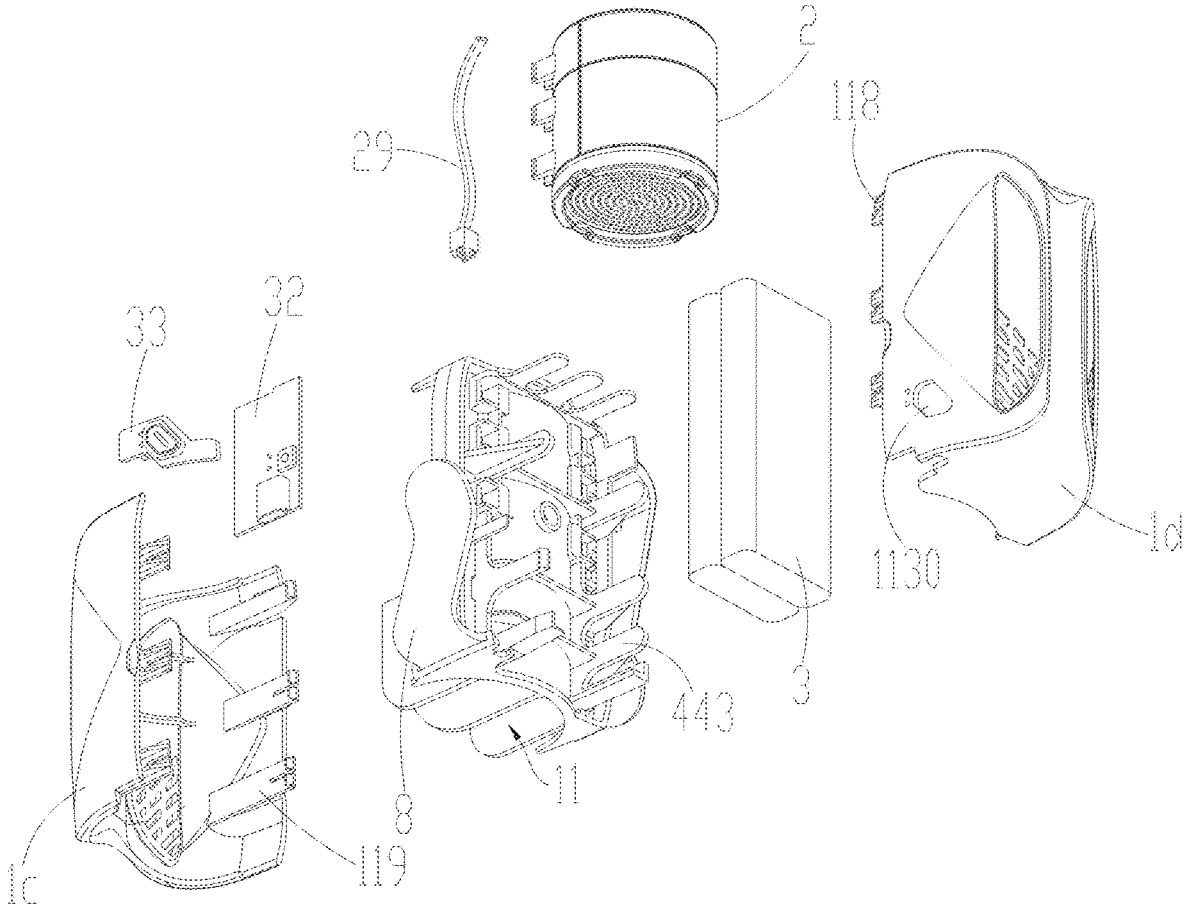
FIG. 9 is an exploded view from another angle of the portable fan shown in FIG. 6.
Figure 10:
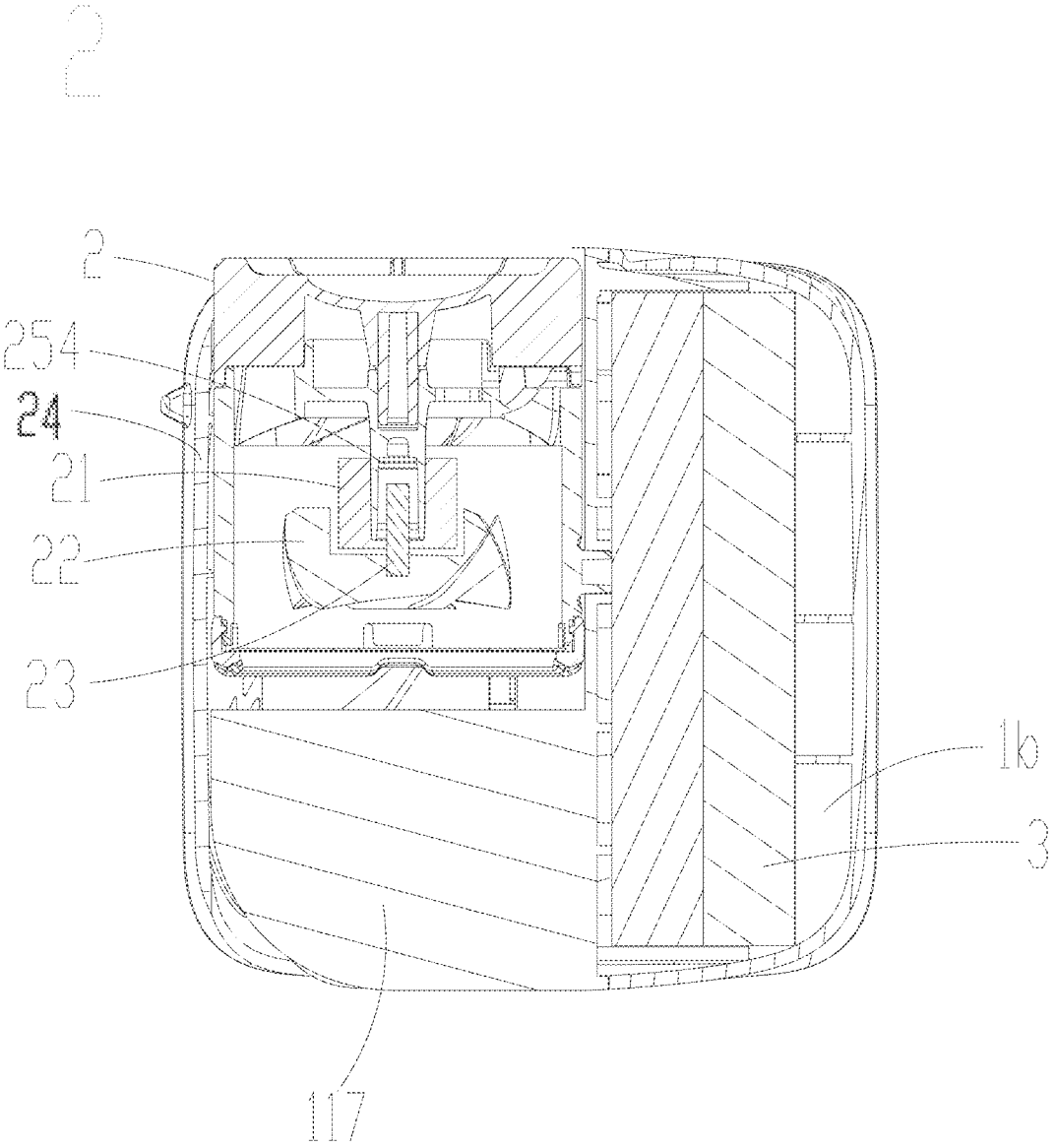
FIG. 10 is a cross-sectional view of the portable fan shown in FIG. 6.
Figure 11:
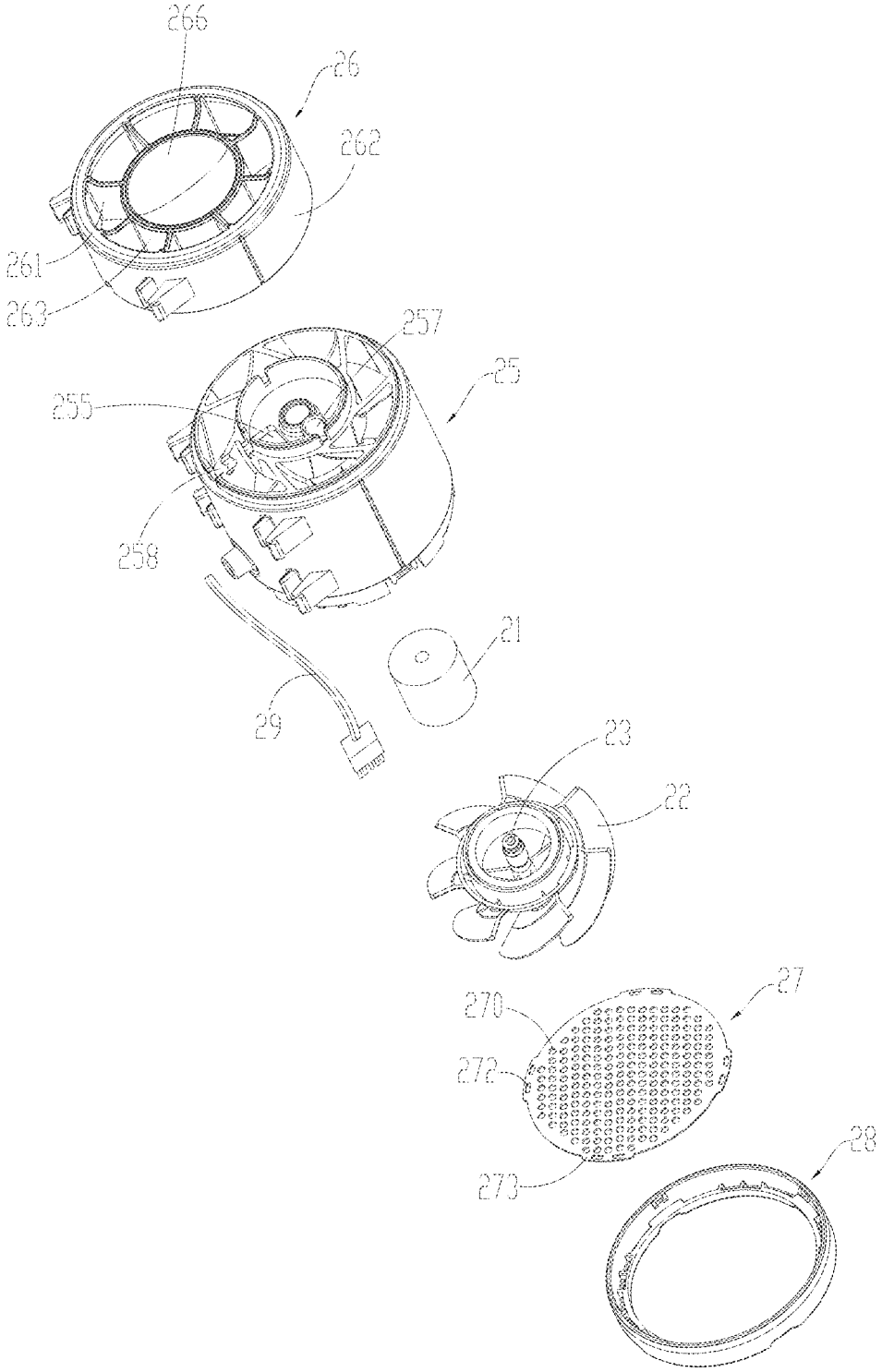
FIG. 11 is an exploded view of a fan assembly of the portable fan shown in FIG. 6.
Figure 12:
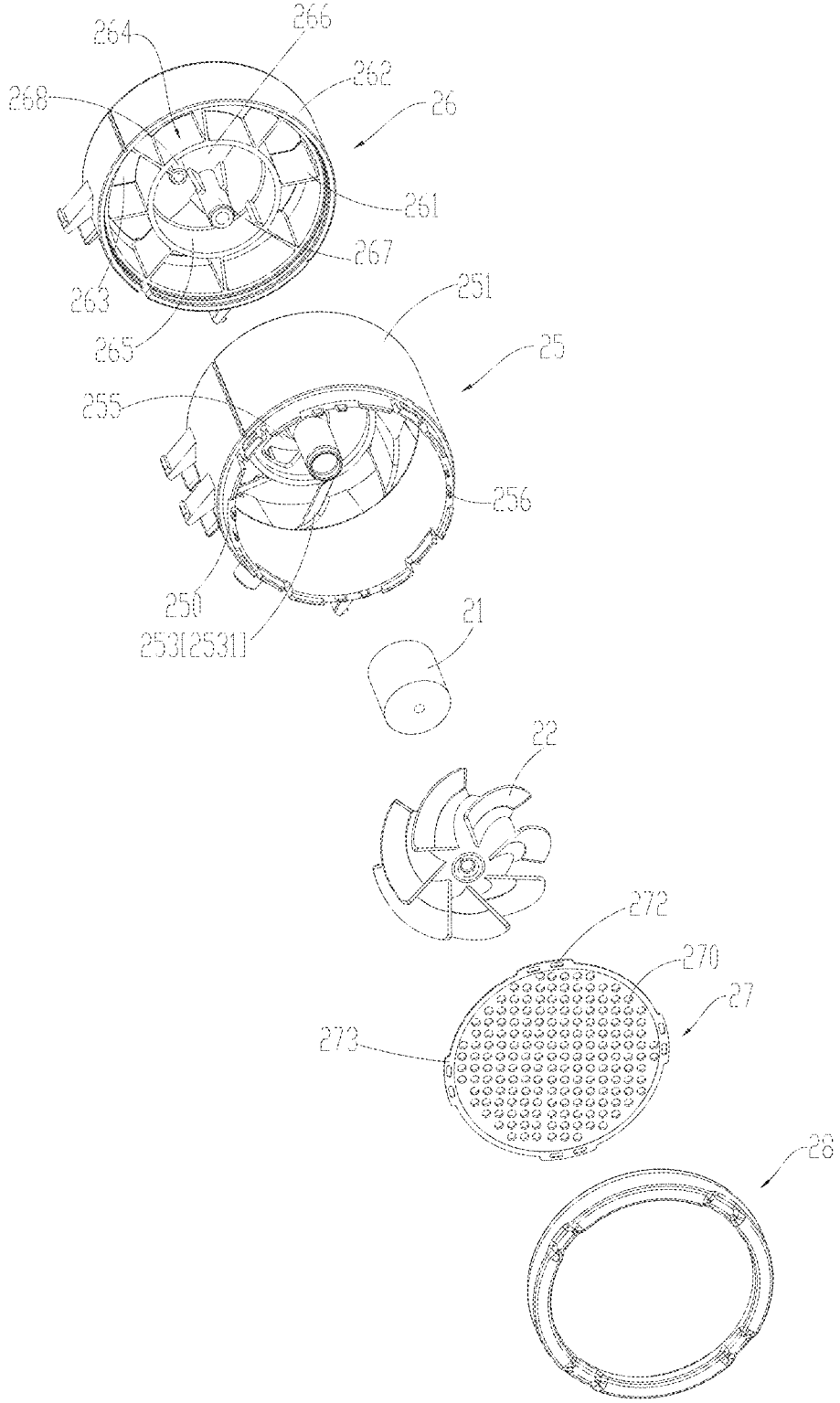
FIG. 12 is an exploded view from another angle of a fan assembly shown in FIG. 11.

Furthermore, as shown in FIG. 2 and FIG. 3, the fan assembly 2 is an axial flow fan assembly. The output shaft 23 is arranged along the first preset direction X-X. When the fan assembly 2 cooperates with the first air inlet 11 and the air outlet 12, which are also located in the first preset direction X-X, the portable fan can be configured as a direct-blowing portable fan. This can achieve a relatively high air-flow efficiency and a relatively strong wind power.

Referring to FIG. 6 to FIG. 12, Embodiment II of the invention provides a portable fan including a housing body 1*a*, a fan assembly 2, a power supply assembly 3, a control assembly 3*a*, a first clamping device 7, and a second clamping device 8.

The housing body 1*a* includes a housing 1 and a mounting shell 4 located within the housing 1. The mounting shell 4 includes a partition plate 441, and the fan assembly 2 and the power supply assembly 3 are respectively positioned on two sides of the partition plate 441. In this embodiment, the first clamping device 7 is connected to the mounting shell 4 and is integrally formed with the mounting shell 4. The housing 1 is provided with a clamping slot 14, and a part of the first clamping device 7 connecting to the mounting shell 4 is fixed within the clamping slot 14.

The housing 1 includes a first portion 1*c* and a second portion 1*d*, and the first portion 1*c*, the mounting shell 4 and the second portion 1*d* are arranged in sequence along the second preset direction Y-Y. A plurality of first clamping members 118 are arranged at an edge of the first portion 1*c*, and a plurality of second clamping members 119 are arranged at an edge of the second portion 1*d*; the mounting shell 4 is provided with a plurality of third clamping members 401 that are snap-fitted with the plurality of first clamping members 118, and a plurality of fourth clamping members 402 that are snap-fitted with the plurality of second clamping members 119, so that the mounting shell 4, the first portion 1*c*, and the second portion 1*d* are connected into a single entity.

An inner side (such as one end of the partition plate adjacent to the fan assembly 2) of the housing body 1*a* is provided with a plurality of air guide plates 117 corresponding to the air inlet 11, and the plurality of air guide plates 117 are located between the air inlet 11 and the fan assembly 2; each air guide plate 117 extends along the first preset direction X-X, and the plurality of air guide plates 117 are arranged in sequence along a direction from the third side 113 to the fourth side 114. The plurality of air guide plates 117 can not only guide the incoming air, but also enhance the exterior aesthetic of the portable fan.

One side of the partition plate 441 facing the fan assembly 2 is an arc-shaped surface. The fan assembly 2 is provided with at least one first snap-fit member 201, and at least one second snap-fit member 108 is arranged on an inner side (such as a surface of the partition plate 441 adjacent to the fan assembly 2) of the housing body 1*a*. The at least one first snap-fit member 201 cooperates with the at least one second snap-fit member 108, so that the fan assembly 2 is fixed within the accommodating chamber 1*b* of the housing body 1*a* where the partition plate 441 is located. The number of the at least one first snap-fit member 201 is multiple, the number of the at least one second snap-fit member 108 is also multiple, and multiple first snap-fit members 201 are respectively arranged on both sides of the fan assembly 2. The first snap-fit member 201 is one of a protrusion and a groove, and the second snap-fit member 108 is the other one of the protrusion and the groove. And the protrusion includes a latching hook portion 202.

The mounting shell 4 further includes at least one limiting and fixing member 443 connected to the partition plate 441 and extending towards the battery 31, and the at least one limiting and fixing member 443 is arranged around a periphery of the battery 31 to fix the battery 31. In this embodiment, the number of the at least one limiting and fixing member 443 is multiple.

The control assembly 3*a* is located within the accommodating chamber 1*b*, and the control assembly includes a control button 33 and a circuit board 32 electrically connected to the control button 33 and the battery 31. The fourth side 114 of the housing body 1*a* is provided with a button hole 1130, and the control button 33 is arranged corresponding to the button hole 1130 and is exposed through the button hole 1130.

The fan assembly 2 includes a motor 21, a fan blade 22 and a fan shell 24. The fan blade 22 is mounted on the output shaft 23, and the motor 21 and the fan blade 22 are arranged within the fan shell 24.

The fan shell 24 includes an air inlet cover 28, a shell main body 25, an air outlet hood 26 and a grille 27. The motor 21 and the fan blade 22 are arranged within the shell main body 25. The air outlet hood 26 is arranged on one side of the shell main body 25 and has a plurality of air outlet holes 260, and the air outlet hood 26 is also located at the air outlet 12. The grille 27 is arranged on the other side of the shell main body 25 and corresponds to the air inlet 11. The air outlet hood 26 includes a plurality of air gathering rings 261 and an annular wall structure 262 connected to a periphery of the plurality of air gathering rings 261. The grille 27 includes a plurality of air inlet holes 270. A plurality of air outlet holes 263 are defined among the plurality of air gathering rings 261, and the air gathering rings 261 are configured to cooperate with an inner side surface of the annular wall structure 262 to pressurize wind from the shell main body 25 and then blow it out.

The inner side surface of the annular wall structure 262 is an inclined surface or an arc-shaped surface, so that an inner diameter of the annular wall structure 262 gradually decreases along a direction from the air inlet 11 to the air outlet 12, thereby pressurizing the blown-out air and increasing the air outlet intensity.

Specifically, the shell main body 25 includes a cylindrical sidewall structure 251, a third mounting part 252 located at one end inside the sidewall structure 251, and an air guide part 253 connected between the third mounting part 252 and the sidewall structure 251. The fan blade 22 and the motor 21 are arranged within the sidewall structure 251 on one side of the third mounting part 252, and the motor 21 is mounted on the third mounting part 252.

The air guide part 253 includes a plurality of air guide blades 2531 arranged at intervals and is configured to guide wind from the fan blade 22 based on a preset direction. Specifically, the thickness of each air guide blade 2531 can gradually increase in a direction from the fan blade 22 to the air outlet 12, thus achieving a better air guide effect. The air inlet cover 28 can be in an annular shape, and the air inlet cover 28 is sleeved on one end of the shell main body 25. Specifically, an outer side surface of one end of the shell main body 25 can be provided with a stepped groove 250, the air inlet cover 28 is sleeved on the stepped groove 250, so that an outer side surface of the air inlet cover 28 is flush with the outer side surface of the shell main body 25 after mounting. The grille 27 can be mounted on an inner side of the air inlet cover 28. The air inlet cover 28 can snap-fit with the shell main body 25.

The air outlet hood 26 further includes a mounting structure 264 connected to the plurality of air gathering rings 261. The mounting structure 264 includes an annular mounting wall 265, a cover plate 266 connected to the mounting wall 265 and a first mounting post 267 connected to an inner side of the cover plate 266, and the first mounting post 267 is connected to the third mounting part 252. Specifically, the first mounting post 267 can be detachably inserted into a mounting hole of the third mounting part 252, so that the air outlet hood 26 and the shell main body 25 form a detachable connection. The cover plate 266 is circular and is positioned in the middle of the plurality of air outlet holes 263. The outer surface of the cover plate 266 is provided with a groove for converging the exhaust air.

Specifically, the inner side surface of the annular wall structure 262 is an inclined surface or an arc-shaped surface, so that an inner diameter of the annular wall structure 262 gradually decreases along the first preset direction X-X, thereby pressurizing the blown-out air and increasing the air outlet intensity.

The grille 27 is a metal barrier net, and the grille 27 is provided with a plurality of air inlet holes 270. The plurality of air inlet holes 270 are configured to reduce air resistance and increase the air intake volume. Each air inlet hole 270 can be circular, and the diameters of the plurality of air inlet holes 270 can be the same. An inner diameter of each air inlet hole 270 ranges from 0.5 mm to 4 mm. Such dimensions can prevent foreign objects from being drawn into the fan assembly 2. It can be understood that the grille 27 has a relatively thin thickness and light weight, which is beneficial to the miniaturization and lightweighting of the product. In addition, due to the use of metal material, the size of the air inlet holes of the grille 27 can be set to be relatively small, thus effectively preventing foreign objects from entering the fan assembly 2. Furthermore, there are a plurality of fixing holes 272 at an edge of the grille 27. The plurality of fixing holes 272 are configured to correspond to a plurality of fixing posts 256 on the shell main body 25. The fixing posts 256 extend into the fixing holes 272 to fix the grille 27 and the shell main body 25. The grille 27 also has a plurality of flanges 273, and the fixing holes 272 are arranged on the flanges 273.

The third mounting part 252 is provided with a blind hole 254 arranged facing the motor 21, an opening of the blind hole 254 faces a side where the motor 21 is located, and the blind hole 254 is configured to store lubricating oil for lubricating the output shaft 23. Due to the blind hole, the leakage of lubricating oil can be reduced, and thus the service life of the motor can be extended.

The third mounting part 252 is provided with an opening 255, a conducting wire 29 connected to the motor 21 passes through the opening 255 and then extends from a gap 258 between the shell main body 25 and the air outlet hood 26 to be connected with the control assembly 3*a* (such as the circuit board 31).

The mounting structure 264 is further provided with a first alignment structure 268, the shell main body 25 has a second alignment structure 257, and the first alignment structure 268 and the second alignment structure 257 cooperate to enable an aligned assembly of the shell main body 25 and the air outlet hood 26.

It can be understood that in this embodiment, the housing 1 includes a first portion 1*c* and a second portion 1*d*. The first portion 1*c*, the mounting shell 4, and the second portion 1*d* can be arranged in sequence along the second preset direction Y-Y, which facilitates the assembly process of the portable fan. Specifically, the fan assembly 2 and the power supply assembly 3 can be first mounted on two sides of the mounting shell 4 respectively. Then, the control assembly 3*a* is mounted on another side of the mounting shell 4, and the fan assembly 2, the power supply assembly 3, and the control assembly 3*a* are electrically connected through electrical connection elements such as conducting wires and connectors. Finally, the first portion 1*c* and the second portion 1*d* are arranged on two sides of the mounting shell 4 along the second preset direction Y-Y, and then assembled with the mounting shell 4 into a single entity along the second preset direction Y-Y. It can be seen that the structural settings of the housing 1 and the mounting shell 4 enable a relatively high assembly efficiency of the portable fan.

Figure 13:
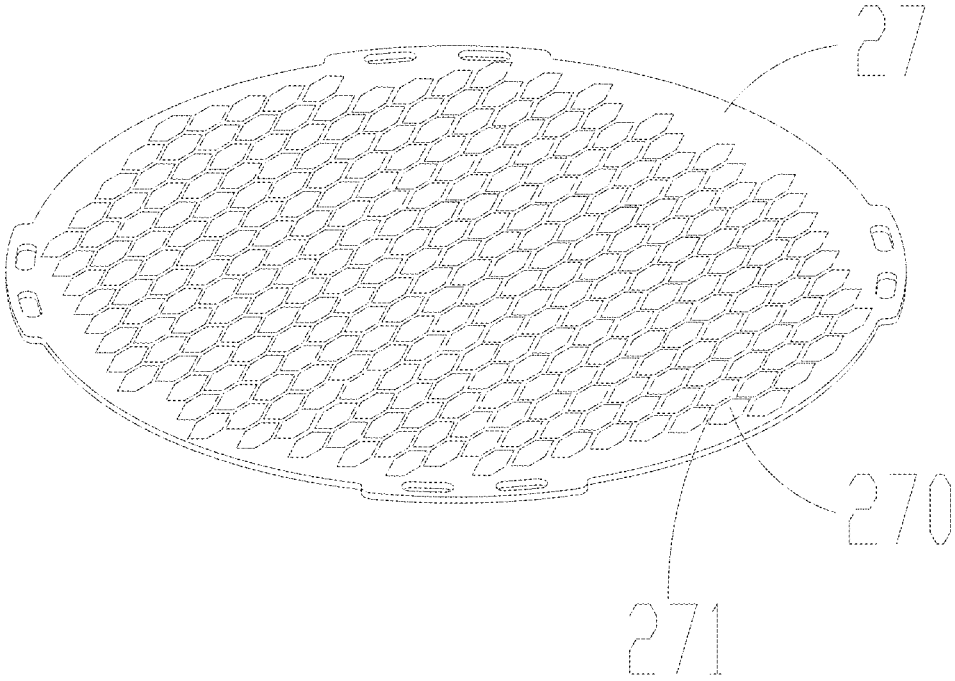
FIG. 13 is a perspective view of a grille of the fan assembly of the portable fan according to Embodiment III of the present invention.

Referring to FIG. 13, in Embodiment III of the invention, a portable fan is provided. In this portable fan, the air inlet hole 270 of the grille 27 is in a regular hexagon shape, and a surrounding wall 271 is arranged between two adjacent air inlet holes 270. Such a design can maximize the air inlet area of the metal barrier net 311, minimize its weight, minimize air resistance, and maximize the air intake volume. The width of the surrounding wall 271 can range from 0.05 mm to 2 mm.

Figure 14:
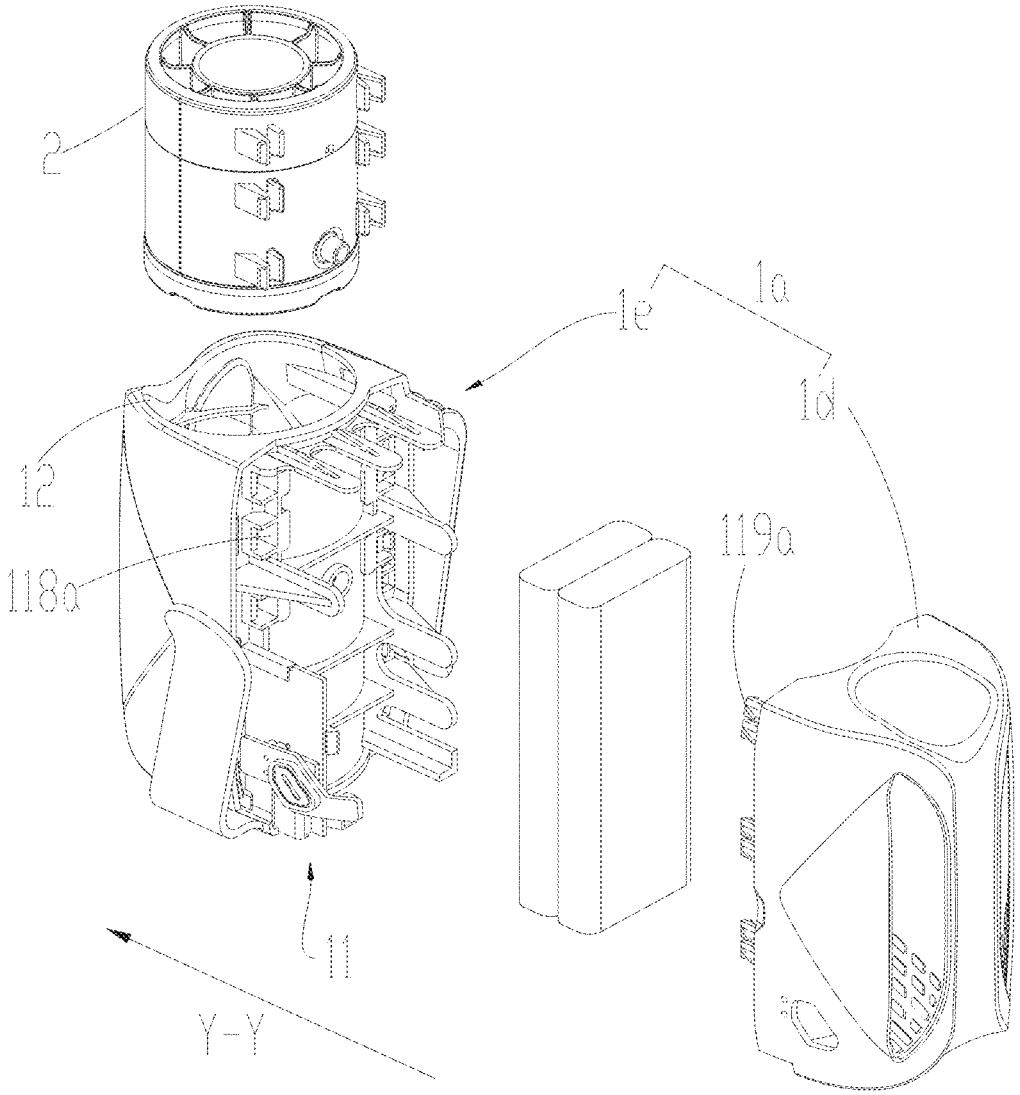
FIG. 14 is an exploded view of the portable fan according to Embodiment IV of the present invention.

Referring to FIG. 14, in Embodiment IV of the present invention, a portable fan is provided. The structure of this portable fan is basically the same as that of the portable fan in Embodiment II. That is to say, the description of the portable fan in Embodiment II is basically applicable to the portable fan in Embodiment IV. The main difference between the two is that, in the portable fan of Embodiment IV, the housing 1*a* includes a first portion 1*e* and a second portion 1*d*. The first portion 1*e* is equivalent to the structure and function of the combination of the first portion 1*c* and the mounting shell 4 in Embodiment II. That is, the first portion 1*e* has an air inlet 11 and an air outlet 12, and can accommodate and fix the fan assembly 2. The fan assembly 2 can be mounted in the first portion 1*e* from the air outlet 11.

Specifically, the first portion 1*e* and the second portion 1*d* can be arranged in sequence along the second preset direction Y-Y. A plurality of first clamping members 118*a* are arranged at an edge of the first portion 1*e*, and a plurality of second clamping members 119*a* are arranged at an edge of the second portion 1*d*. The plurality of first clamping members 118*a* and the plurality of second clamping members 119*a* are snap-fitted together to connect the first portion 1*e* and the second portion 1*d* into a single entity.

Figure 15:
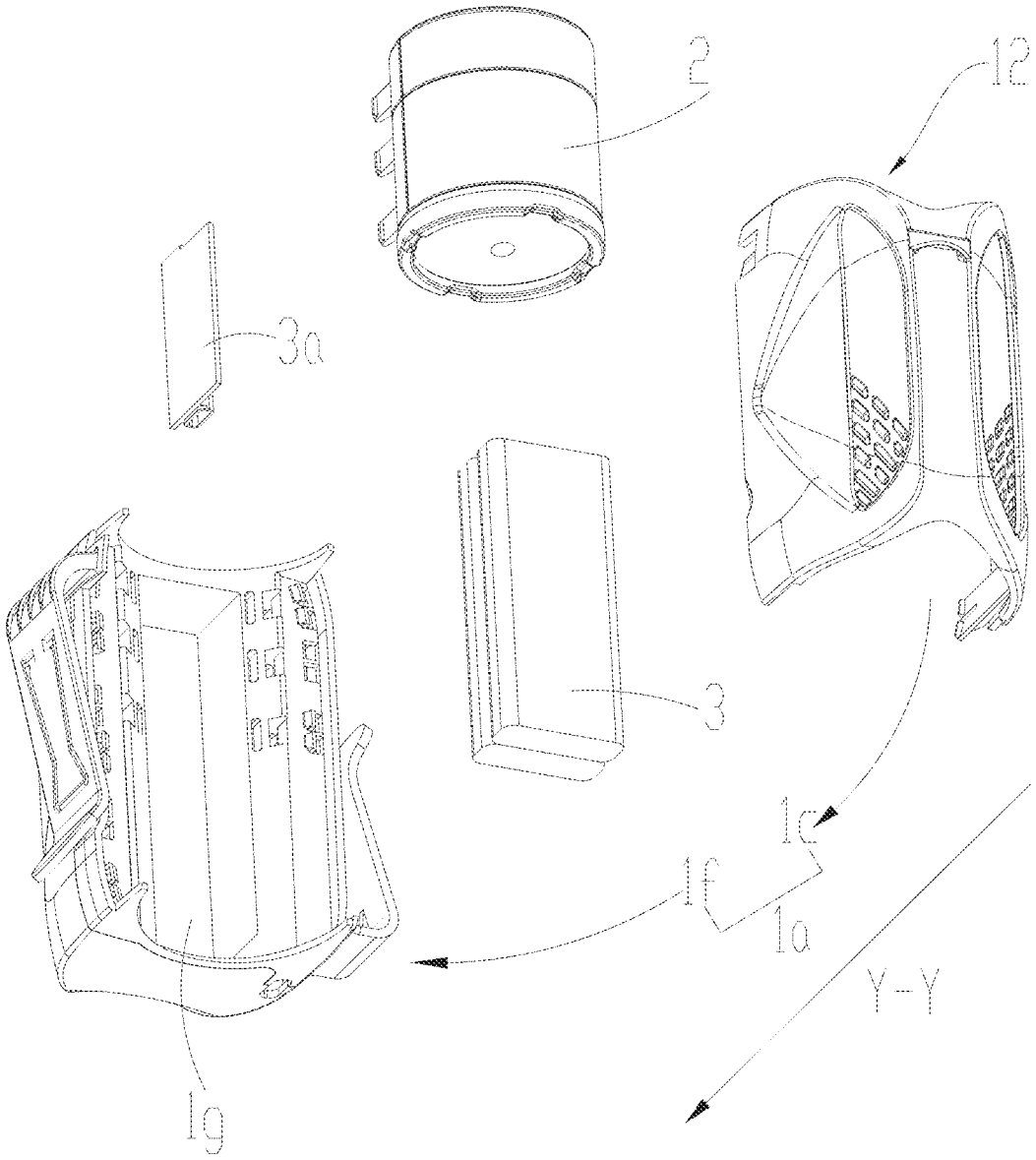
FIG. 15 is an exploded view of the portable fan according to Embodiment V of the present invention.

Referring to FIG. 15, in Embodiment V of the present invention, a portable fan is provided. The structure of this portable fan is basically the same as that of the portable fan in Embodiment II. That is to say, the description of the portable fan in Embodiment II is basically applicable to the portable fan in Embodiment V. The main difference between the two is that, in the portable fan of Embodiment V, the housing 1*a* includes a first portion 1*c* and a second portion 1*f*. The second portion 1*f* is equivalent to the structure and function of the combination of the second portion 1*d* and the mounting shell 4 in Embodiment II. That is, the first portion 1*c* and the second portion 1*f* jointly enclose the air inlet 11 and the air outlet 12. The fan assembly 2 is fixed to either the first portion 1*c* or the second portion 1*f*. The side of the second portion 1*f* facing the fan assembly 2 has a mounting groove 1*g*, and the power supply assembly 3 can be mounted in the mounting groove 1*g*. During assembly, the power supply assembly 3 can be first mounted in the mounting groove 1*g*, then the control assembly 3*a* is mounted in the second portion 1*f*, then the fan assembly 2 is mounted on either the first portion 1*c* or the second portion 1*f*, and the fan assembly 2, the control assembly 3*a*, and the power supply assembly 3 are electrically connected. Finally, the first portion 1*c* and the second portion 1*f* are assembled together along the second preset direction Y-Y.

Figure 16:
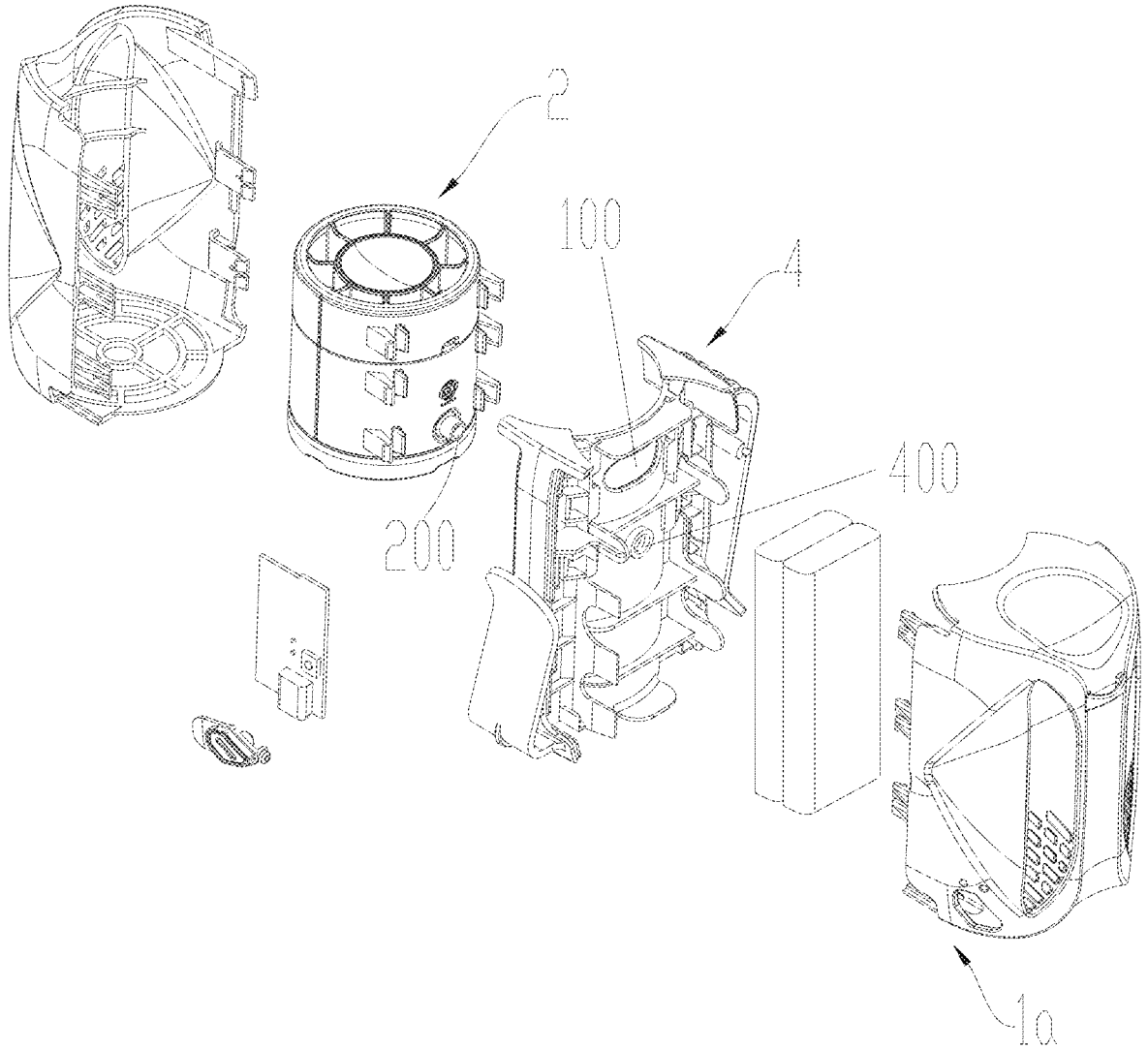
FIG. 16 is an exploded view of the portable fan according to Embodiment VI of the present invention.
Figure 17:
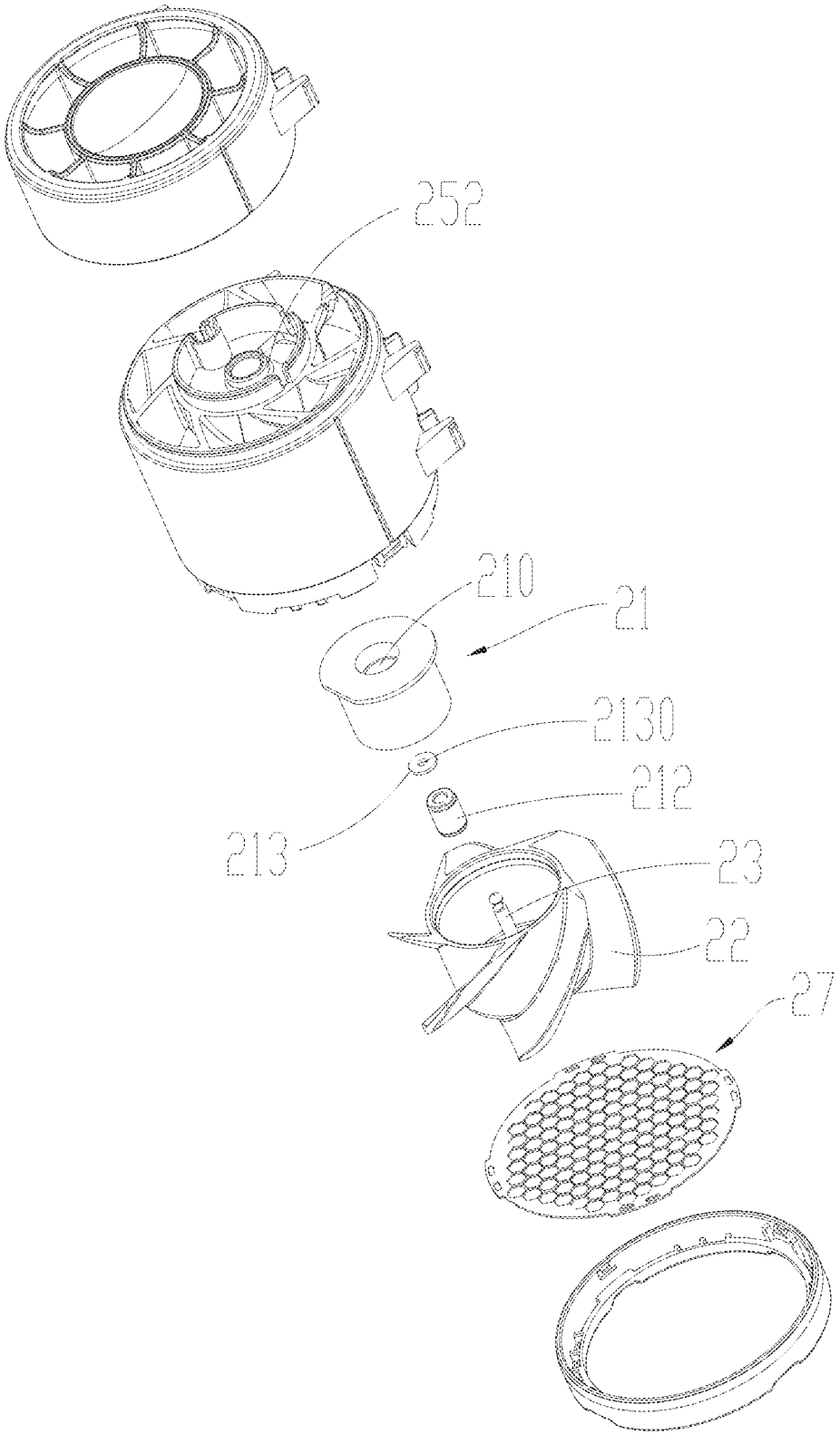
FIG. 17 is an exploded view of the fan assembly of the portable fan shown in FIG. 16.
Figure 18:
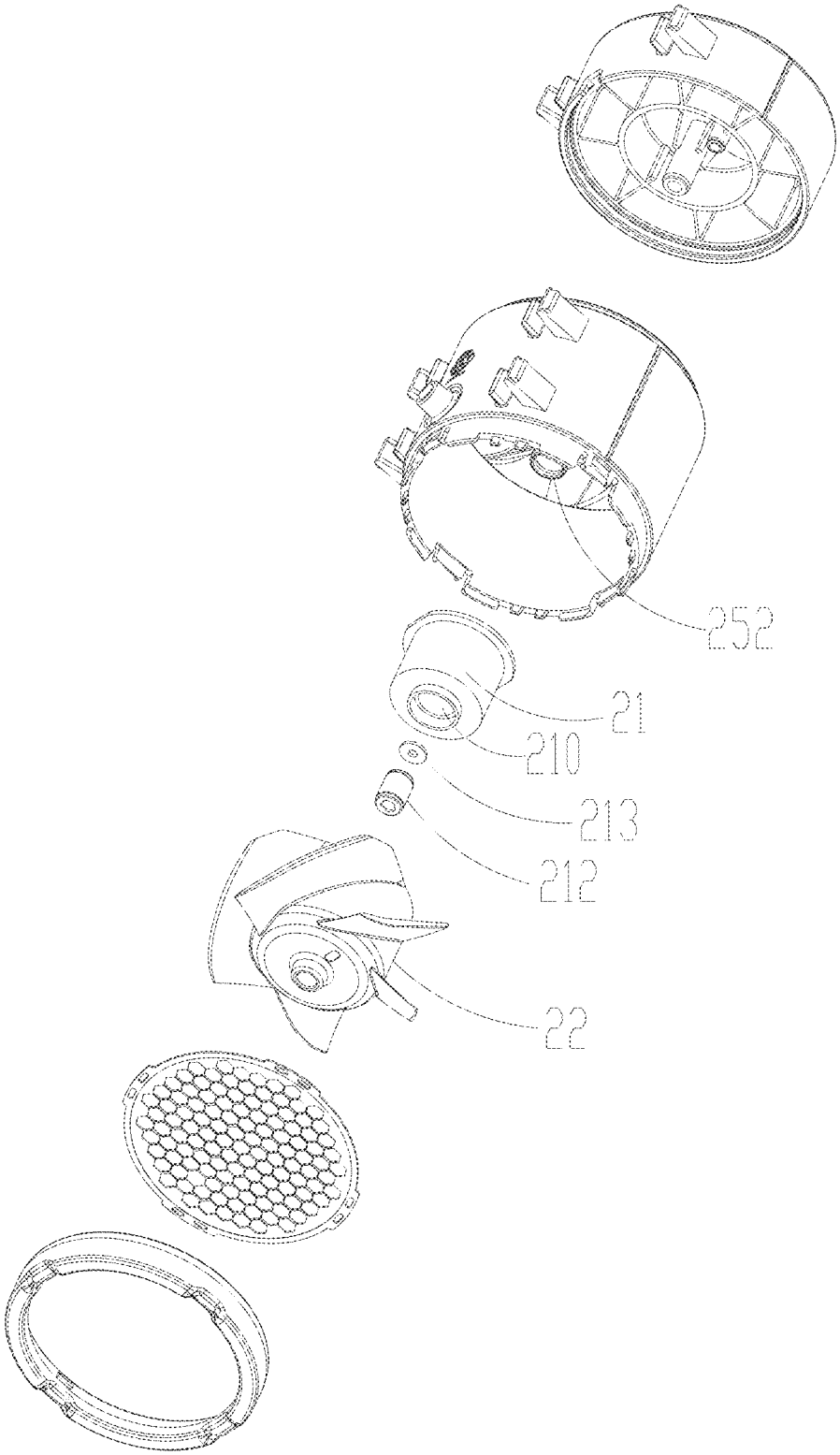
FIG. 18 is an exploded view from another angle of the fan assembly shown in FIG. 17.

Referring to FIG. 16, in Embodiment VI of the present invention, a portable fan is provided. The structure of this portable fan is basically the same as that of the portable fan in Embodiment II. That is to say, the description of the portable fan in Embodiment II is basically applicable to the portable fan in Embodiment VI. The following mainly describes the key parts of Embodiment VI: Specifically, the mounting part 252 includes a mounting plate 2521 and a second mounting post 2522 that is connected to the mounting plate 2521 and extends towards the air outlet hood 26. The blind hole 254 is arranged on the second mounting post 2522. The motor 21 has a motor mounting hole 210. The motor mounting hole 210 is sleeved on the second mounting post 2522 so that the motor 21 is mounted on the second mounting post 2522.

A fixing post 212 with a through hole 211 as well as a limiting ring 213 is also arranged within the blind hole 254. The output shaft 23 includes a main body 231 connected to the fan blade 22 and a limiting part 232 connected to the main body 231. The main body 231 of the output shaft 23 sequentially passes through the fixing post 212 and the limiting ring 213, and makes the limiting part 232 located at one end of the limiting ring 213 away from the fixing post 212. The limiting part 232 includes a rod part 2321 and a limiting end 2322 connected to one end of the rod part 2321 away from the fan blade 22. A diameter of the limiting end 2322 gradually decreases in a direction away from the fan blade 22. An outer surface of the rod part 2321, together with the limiting end 2322 and the main body 231, encloses a limiting groove 2323. The limiting ring 213 has a limiting hole 2130. A diameter of the limiting hole 2130 is greater than that of the rod part 2321 and less than that of the main body 231 and that of the limiting end 2322, so that the limiting ring 213 is limited within the limiting groove 2323.

The fixing post 212 can be a copper post, and the limiting ring 213 can be an elastic spring piece such as a torsion spring or a snap spring.

Figure 19:
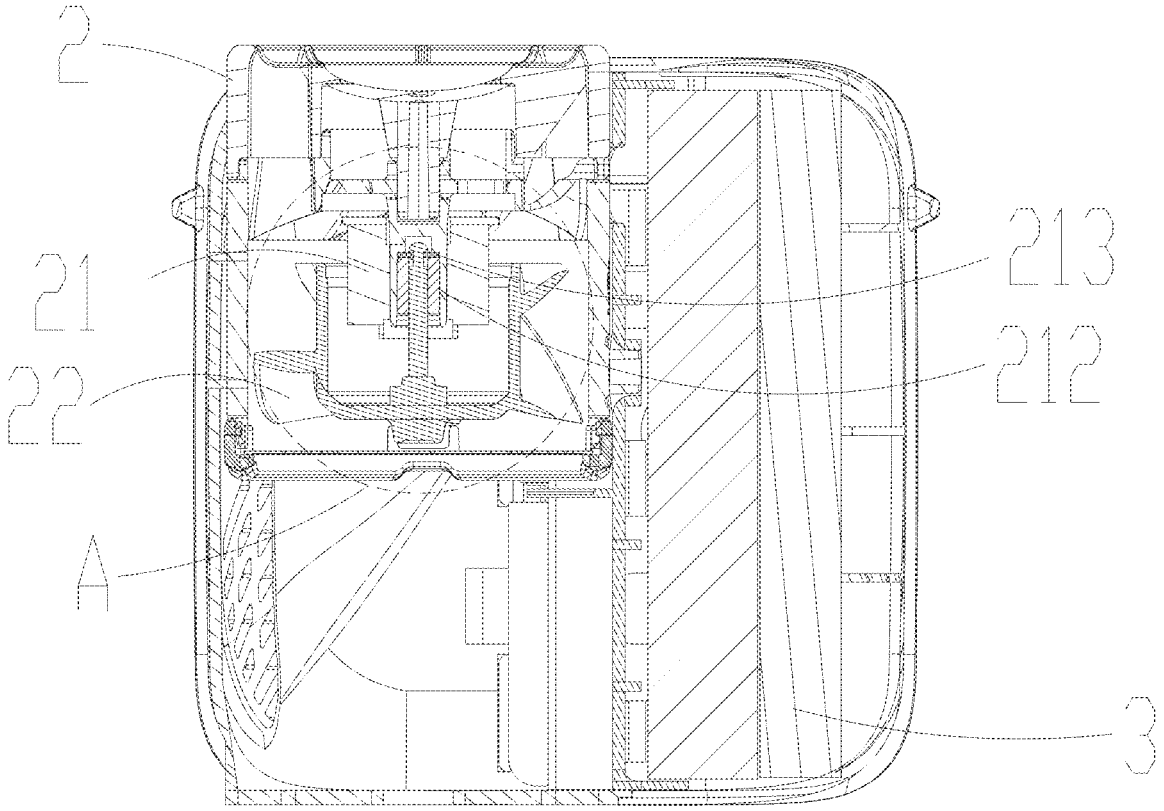
FIG. 19 is a cross-sectional view when an output shaft and a fan blade are in a first limiting position of the portable fan shown in FIG. 16.
Figure 20:
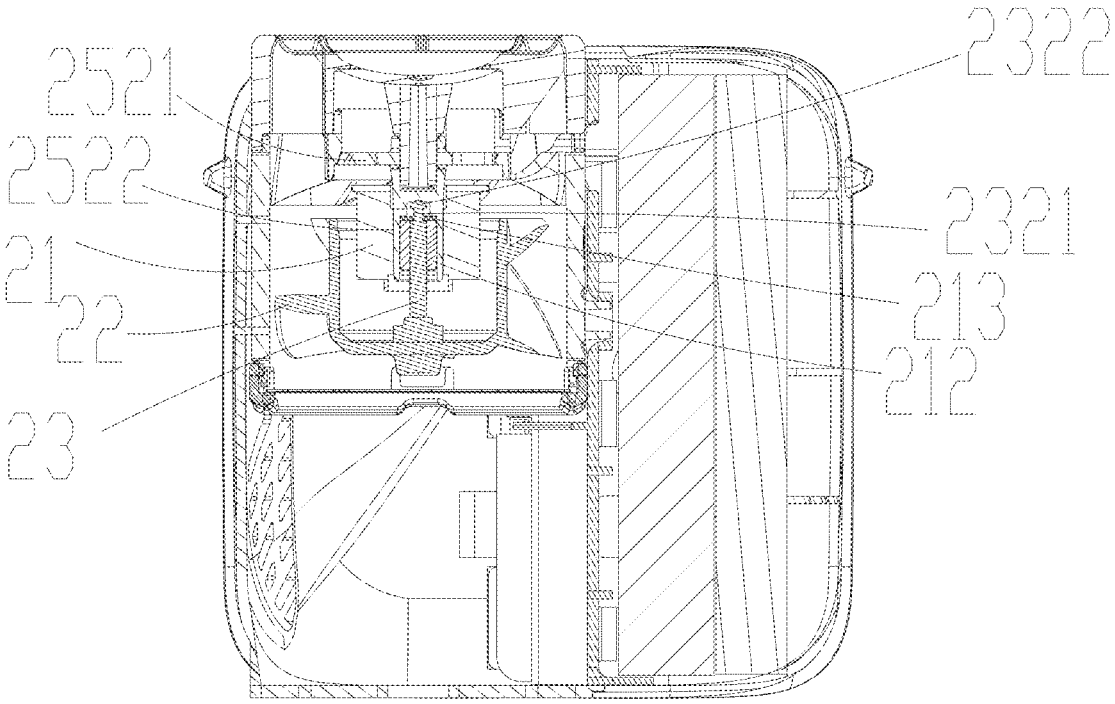
FIG. 20 is a cross-sectional view when the output shaft and the fan blade are in a second limiting position of the portable fan shown in FIG. 16.
Figure 21:
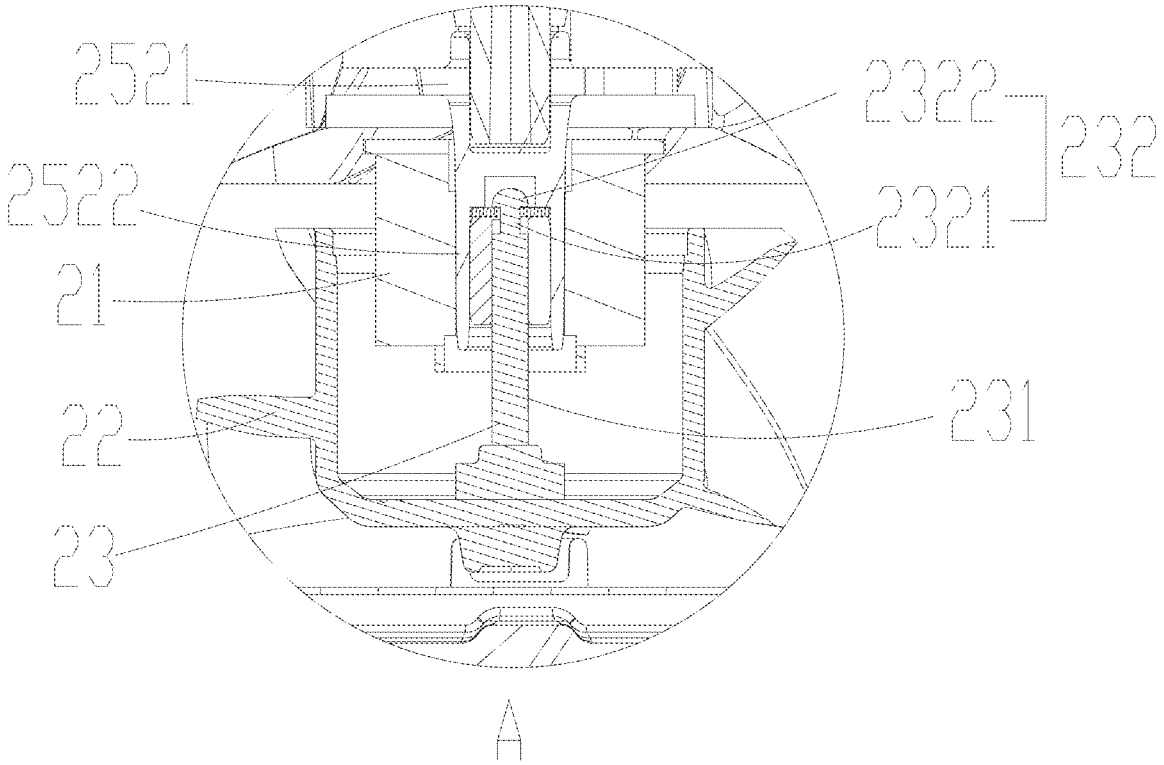
FIG. 21 is an enlarged diagram of an area A in FIG. 19.

It can be understood that through the arranging of the above structure, the limiting ring 213 is limited within the limiting groove 2323, and the output shaft 23 drives the fan blade 22 to move within the length range of the limiting groove 2323 along an extending direction of the output shaft. Specifically, the output shaft 23 and the fan blade 22 respectively have a first limiting position shown in FIG. 19 and a second limiting position shown in FIG. 20, so that the fan blade 22 is suspended relative to the motor 21. During the rotation of the output shaft 23 and that of the fan blade 22, the limiting ring 213 can provide space for their movement, making the rotation of the output shaft 23 and the fan blade 22 more smooth, thereby improving the service life of the fan assembly 2.

The conducting wire 29 connected to the motor 21 can be electrically connected to the battery 31 of the power supply assembly 3 through an opening 100 within the housing 1*a* (such as the mounting shell 4).

The fan assembly 2 can also be provided with a positioning post 200. The positioning post 200 can be located at a middle position of an outer side of the fan assembly 2, and the positioning post 200 can extend into a positioning hole 400 within the housing 1*a*, so as to be further assembled and positioned with the mounting shell 4.

One or more implementation modes are provided above in combination with specific contents, and it is not deemed that the specific implementation of the present invention is limited to these specifications. Any technical deductions or replacements approximate or similar to the method and structure of the present invention or made under the concept of the present invention shall fall within the scope of protection of the present invention.

What is claimed is:

1. A portable fan, comprising:

a housing body, wherein the housing body is provided with an accommodating chamber, an air inlet, and an air outlet; the air outlet, at least part of the accommodating chamber and the air inlet are communicated to each other in sequence along a first preset direction;

a fan assembly, wherein the fan assembly is located within the accommodating chamber and between the air inlet and the air outlet, and is configured to drive an air flow to flow from the air inlet to the air outlet;

a power supply assembly, wherein the power supply assembly is located within the accommodating chamber, the power supply assembly is offset from a projection of the fan assembly along the first preset direction, and the power supply assembly is electrically connected to the fan assembly to supply power to the fan assembly; and a first clamping device, wherein the first clamping device is connected to one side of the housing body, and is configured to form a clamping space with the housing body for clamping an external object, so as to fix the portable fan onto the external object;

wherein the fan assembly comprises a motor, a fan blade and an output shaft; the fan blade is mounted on the output shaft, the fan assembly is an axial flow fan assembly, and the output shaft is arranged along the first preset direction;

the fan assembly further comprises a fan shell, the fan shell comprises a shell main body and an air outlet hood; the motor and the fan blade are arranged within the shell main body; the air outlet hood is arranged on one side of the shell main body and has a plurality of air outlet holes, and the air outlet hood is also located at the air outlet; the air outlet hood comprises a plurality of air gathering rings and an annular wall structure connected to a periphery of the plurality of air gathering rings; a plurality of air outlet holes are defined among the plurality of air gathering rings, and the air gathering rings are configured to cooperate with an inner side surface of the annular wall structure to pressurize wind from the shell main body and then blow it out of the fan shell; and the inner side surface of the annular wall structure is an inclined surface or an arc-shaped surface, so that an inner diameter of the annular wall structure gradually decreases along the first preset direction.

2. The portable fan according to claim 1, wherein the housing body has a first side, a second side, and a third side; the first side and the second side are arranged opposite to each other; the air outlet is arranged on the first side, and the air inlet is arranged on the second side; the third side is located between the first side and the second side and is adjacent to both the first side and the second side; the first clamping device extends along the first preset direction and is connected to the third side of the housing body, wherein the housing body further has a fourth side, a fifth side, and a sixth side; the fourth side and the third side are arranged opposite to each other, and the fifth side and the sixth side are arranged opposite to each other; a direction from the fifth side to the sixth side is a second preset direction, and the fan assembly and the power supply assembly are arranged in sequence along the second preset direction.

3. The portable fan according to claim 2, further comprising a second clamping device, wherein the second clamping device is connected to the fourth side of the housing body, and the second clamping device is further configured to form a clamping space with the housing body for clamping an external object, so as to fix the portable fan onto the external object; the first clamping device is connected to one end of the third side of the housing body adjacent to the air outlet, the second clamping device is connected to one end of the fourth side of the housing body adjacent to the air inlet, and the second clamping device extends in a direction opposite to that of the first clamping device.

4. The portable fan according to claim 2, wherein a direction from the third side to the fourth side is a third preset direction, and a maximum diameter of the housing body along the second preset direction is greater than a maximum diameter of the housing body along the third preset direction; a first hook is further arranged at one end of the fifth side of the housing body adjacent to the air outlet, and both ends of the first hook are connected to the fifth side of the housing body and form a first hook hole with the housing body; a second hook is further arranged at one end of the sixth side of the housing body adjacent to the air outlet, and both ends of the second hook are connected to the sixth side of the housing body and form a second hook hole with the housing body.

5. The portable fan according to claim 1, wherein the fan assembly is provided with at least one first snap-fit member, at least one second snap-fit member is arranged on an inner side of the housing body, and the at least one first snap-fit member cooperates with the at least one second snap-fit member, so that the fan assembly is fixed within the accommodating chamber of the housing body; the number of the at least one first snap-fit member is multiple, the number of the at least one second snap-fit member is also multiple, and multiple first snap-fit members are respectively arranged on both sides of the fan assembly; the first snap-fit member is one of a protrusion and a groove, and the second snap-fit member is the other one of the protrusion and the groove; the protrusion comprises a latching hook portion.

6. The portable fan according to claim 1, wherein the fan shell further comprises a grille arranged on another side of the shell main body; the grille comprises a plurality of air inlet holes.

7. The portable fan according to claim 6, wherein the grille is a metal barrier net, the metal barrier net is provided with a plurality of air inlet holes, and an inner diameter of each air inlet hole ranges from 0.5 mm to 4 mm.

8. The portable fan according to claim 7, wherein the air inlet hole is in a regular hexagon shape, a surrounding wall is arranged between two adjacent air inlet holes, and a width of the surrounding wall ranges from 0.05 mm to 2 mm.

9. A portable fan, comprising:

a housing body, wherein the housing body is provided with an accommodating chamber, an air inlet, and an air outlet; the air outlet, at least part of the accommodating chamber and the air inlet are communicated to each other in sequence along a first preset direction;

a fan assembly, wherein the fan assembly is located within the accommodating chamber and between the air inlet and the air outlet, and is configured to drive an air flow to flow from the air inlet to the air outlet;

a power supply assembly, wherein the power supply assembly is located within the accommodating chamber, the power supply assembly is offset from a projection of the fan assembly along the first preset direction, and the power supply assembly is electrically connected to the fan assembly to supply power to the fan assembly; and a first clamping device, wherein the first clamping device is connected to one side of the housing body, and is configured to form a clamping space with the housing body for clamping an external object, so as to fix the portable fan onto the external object;

wherein the fan assembly comprises a motor, a fan blade and an output shaft; the fan blade is mounted on the output shaft, the fan assembly is an axial flow fan assembly, and the output shaft is arranged along the first preset direction;

the fan assembly further comprises a fan shell, the fan shell comprises a shell main body and an air outlet hood; the motor and the fan blade are arranged within the shell main body; the air outlet hood is arranged on one side of the shell main body and has a plurality of air outlet holes, and the air outlet hood is also located at the air outlet; the air outlet hood comprises a plurality of air gathering rings and an annular wall structure connected to a periphery of the plurality of air gathering rings; a plurality of air outlet holes are defined among the plurality of air gathering rings, and the air gathering rings are configured to cooperate with an inner side surface of the annular wall structure to pressurize wind from the shell main body and then blow it out of the fan shell; and wherein the air outlet hood further comprises a mounting structure connected to the plurality of air gathering rings; the mounting structure comprises an annular mounting wall, a cover plate connected to the annular mounting wall and a first mounting post connected to an inner side of the cover plate, and the first mounting post is configured to be mounted corresponding to a mounting hole of the shell main body; the cover plate is positioned in the middle of the plurality of air outlet holes, an outer surface of the cover plate is provided with a groove, the mounting structure is further provided with a first alignment structure, the shell main body has a second alignment structure, and the first alignment structure and the second alignment structure cooperate to enable an aligned assembly of the shell main body and the air outlet hood.

10. A portable fan, comprising:

a housing body, wherein the housing body is provided with an accommodating chamber, an air inlet, and an air outlet; the air outlet, at least part of the accommodating chamber and the air inlet are communicated to each other in sequence along a first preset direction;

a fan assembly, wherein the fan assembly is located within the accommodating chamber and between the air inlet and the air outlet, and is configured to drive an air flow to flow from the air inlet to the air outlet;

a power supply assembly, wherein the power supply assembly is located within the accommodating chamber, the power supply assembly is offset from a projection of the fan assembly along the first preset direction, and the power supply assembly is electrically connected to the fan assembly to supply power to the fan assembly; and a first clamping device, wherein the first clamping device is connected to one side of the housing body, and is configured to form a clamping space with the housing body for clamping an external object, so as to fix the portable fan onto the external object;

wherein the fan assembly comprises a motor, a fan blade and an output shaft; the fan blade is mounted on the output shaft, the fan assembly is an axial flow fan assembly, and the output shaft is arranged along the first preset direction;

the fan assembly further comprises a fan shell, the fan shell comprises a shell main body and an air outlet hood; the motor and the fan blade are arranged within the shell main body; the air outlet hood is arranged on one side of the shell main body and has a plurality of air outlet holes, and the air outlet hood is also located at the air outlet; the air outlet hood comprises a plurality of air gathering rings and an annular wall structure connected to a periphery of the plurality of air gathering rings; a plurality of air outlet holes are defined among the plurality of air gathering rings, and the air gathering rings are configured to cooperate with an inner side surface of the annular wall structure to pressurize wind from the shell main body and then blow it out of the fan shell; and wherein the shell main body comprises a cylindrical arranged sidewall structure, a mounting part located at one end inside the sidewall structure and an air guide part connected between the mounting part and the sidewall structure, the air guide part comprises a plurality of air guide blades arranged at intervals and is configured to guide wind from the fan blade based on a preset direction, the fan blade and the motor are arranged within the sidewall structure on one side of the mounting part, and the motor is mounted on the mounting part; the mounting part is provided with an opening, a conducting wire connected to the motor passes through the opening and then extends from a gap between the shell main body and the air outlet hood to be connected with a control assembly.

11. The portable fan according to claim 10, wherein the mounting part is provided with a blind hole arranged facing the motor, an opening of the blind hole faces a side where the motor is located, and the blind hole is configured to store lubricating oil required for a rotation of the output shaft; the mounting part comprises a mounting plate and a second mounting post connected to the mounting plate and extending towards the grille, and the blind hole is arranged on the second mounting post; the motor has a motor mounting hole, and the motor mounting hole is sleeved on the second mounting post, thereby the motor is mounted on the second mounting post; a fixing post with a through hole as well as a limiting ring is also arranged within the blind hole, the output shaft passes through the fixing post and the limiting ring, and a limiting part is located at one end of the limiting ring away from the fixing post; the output shaft comprises a main body connected to the fan blade and a limiting part connected to the main body; the limiting part comprises a rod part and a limiting end connected to one end of the rod part away from the fan blade; a diameter of the limiting end gradually decreases in a direction away from the blade; an outer surface of the rod part, together with the limiting end and the main body, encloses a limiting groove; the limiting ring has a limiting hole, a diameter of the limiting hole is greater than that of the rod part and less than that of the main body and that of the limiting end, so that the limiting ring is limited within the limiting groove.

12. A portable fan, comprising:

a housing body, wherein the housing body is provided with an accommodating chamber, an air inlet, and an air outlet; the air outlet, at least part of the accommodating chamber and the air inlet are communicated to each other in sequence along a first preset direction;

a fan assembly, wherein the fan assembly is located within the accommodating chamber and between the air inlet and the air outlet, and is configured to drive an air flow to flow from the air inlet to the air outlet;

a power supply assembly, wherein the power supply assembly is located within the accommodating chamber, the power supply assembly is offset from a projection of the fan assembly along the first preset direction, and the power supply assembly is electrically connected to the fan assembly to supply power to the fan assembly; and a first clamping device, wherein the first clamping device is connected to one side of the housing body, and is configured to form a clamping space with the housing body for clamping an external object, so as to fix the portable fan onto the external object;

wherein the fan assembly comprises a motor, a fan blade and an output shaft; the fan blade is mounted on the output shaft, the fan assembly is an axial flow fan assembly, and the output shaft is arranged along the first preset direction;

the fan assembly further comprises a fan shell, the fan shell comprises a shell main body and an air outlet hood; the motor and the fan blade are arranged within the shell main body; the air outlet hood is arranged on one side of the shell main body and has a plurality of air outlet holes, and the air outlet hood is also located at the air outlet; the air outlet hood comprises a plurality of air gathering rings and an annular wall structure connected to a periphery of the plurality of air gathering rings; a plurality of air outlet holes are defined among the plurality of air gathering rings, and the air gathering rings are configured to cooperate with an inner side surface of the annular wall structure to pressurize wind from the shell main body and then blow it out of the fan shell; and wherein the fan shell further comprises an air inlet cover, the grille is mounted on an inner side of the air inlet cover, the air inlet cover is arranged on one end of the shell main body away from the air outlet hood, the air inlet cover is in an annular shape, and the air inlet cover is sleeved on one end of the shell main body; an outer side surface of one end of the shell main body can be provided with a stepped groove, the air inlet cover is sleeved on the stepped groove, and an outer side surface of the air inlet cover is flush with the outer side surface of the shell main body.

13. A portable fan, comprising:

a housing body, wherein the housing body is provided with an accommodating chamber, an air inlet, and an air outlet; the air outlet, at least part of the accommodating chamber and the air inlet are communicated to each other in sequence along a first preset direction;

a fan assembly, wherein the fan assembly is located within the accommodating chamber and between the air inlet and the air outlet, and is configured to drive an air flow to flow from the air inlet to the air outlet;

a power supply assembly, wherein the power supply assembly is located within the accommodating chamber, the power supply assembly is offset from a projection of the fan assembly along the first preset direction, and the power supply assembly is electrically connected to the fan assembly to supply power to the fan assembly; and a first clamping device, wherein the first clamping device is connected to one side of the housing body, and is configured to form a clamping space with the housing body for clamping an external object, so as to fix the portable fan onto the external object;

wherein the housing body has a first side, a second side, and a third side; the first side and the second side are arranged opposite to each other; the air outlet is arranged on the first side, and the air inlet is arranged on the second side; the third side is located between the first side and the second side and is adjacent to both the first side and the second side;

wherein the housing body further has a fourth side, a fifth side, and a sixth side; the fourth side and the third side are arranged opposite to each other, and the fifth side and the sixth side are arranged opposite to each other; a direction from the fifth side to the sixth side is a second preset direction, and the fan assembly and the power supply assembly are arranged in sequence along the second preset direction; and wherein the housing body comprises a first portion and a second portion, the first portion and the second portion are arranged in sequence along the second preset direction; a plurality of first clamping members are arranged at an edge of the first portion, and a plurality of second clamping members are arranged at an edge of the second portion; the plurality of first clamping members and the plurality of second clamping members are snap-fitted together to connect the first portion and the second portion into a single entity.

14. A portable fan, comprising:

a housing body, wherein the housing body is provided with an accommodating chamber, an air inlet, and an air outlet; the air outlet, at least part of the accommodating chamber and the air inlet are communicated to each other in sequence along a first preset direction;

a fan assembly, wherein the fan assembly is located within the accommodating chamber and between the air inlet and the air outlet, and is configured to drive an air flow to flow from the air inlet to the air outlet;

a power supply assembly, wherein the power supply assembly is located within the accommodating chamber, the power supply assembly is offset from a projection of the fan assembly along the first preset direction, and the power supply assembly is electrically connected to the fan assembly to supply power to the fan assembly; and a first clamping device, wherein the first clamping device is connected to one side of the housing body, and is configured to form a clamping space with the housing body for clamping an external object, so as to fix the portable fan onto the external object;

wherein the housing body has a first side, a second side, and a third side; the first side and the second side are arranged opposite to each other; the air outlet is arranged on the first side, and the air inlet is arranged on the second side; the third side is located between the first side and the second side and is adjacent to both the first side and the second side;

wherein the housing body further has a fourth side, a fifth side, and a sixth side; the fourth side and the third side are arranged opposite to each other, and the fifth side and the sixth side are arranged opposite to each other; a direction from the fifth side to the sixth side is a second preset direction, and the fan assembly and the power supply assembly are arranged in sequence along the second preset direction; and wherein the housing body comprises a first portion, a second portion, and a mounting shell; the first portion, the mounting shell, and the second portion are arranged in sequence along the second preset direction; a plurality of first clamping members are arranged at an edge of the first portion, and a plurality of second clamping members are arranged at an edge of the second portion; the mounting shell is provided with a plurality of third clamping members that are snap-fitted with the plurality of first clamping members, and a plurality of fourth clamping members that are snap-fitted with the plurality of second clamping members, so that the mounting shell, the first portion and the second portion are connected into a single entity.

15. A portable fan, comprising:

a housing body, wherein the housing body is provided with an accommodating chamber, an air inlet, and an air outlet; the air outlet, at least part of the accommodating chamber and the air inlet are communicated to each other in sequence along a first preset direction;

a fan assembly, wherein the fan assembly is located within the accommodating chamber and between the air inlet and the air outlet, and is configured to drive an air flow to flow from the air inlet to the air outlet;

a power supply assembly, wherein the power supply assembly is located within the accommodating chamber, the power supply assembly is offset from a projection of the fan assembly along the first preset direction, and the power supply assembly is electrically connected to the fan assembly to supply power to the fan assembly; and a first clamping device, wherein the first clamping device is connected to one side of the housing body, and is configured to form a clamping space with the housing body for clamping an external object, so as to fix the portable fan onto the external object;

wherein the housing body has a first side, a second side, and a third side; the first side and the second side are arranged opposite to each other; the air outlet is arranged on the first side, and the air inlet is arranged on the second side; the third side is located between the first side and the second side and is adjacent to both the first side and the second side;

wherein the housing body further has a fourth side, a fifth side, and a sixth side; the fourth side and the third side are arranged opposite to each other, and the fifth side and the sixth side are arranged opposite to each other; a direction from the fifth side to the sixth side is a second preset direction, and the fan assembly and the power supply assembly are arranged in sequence along the second preset direction; and wherein an inner side of the housing body is provided with a plurality of air guide plates corresponding to the air inlet, and the plurality of air guide plates are located between the air inlet and the fan assembly; each air guide plate extends along the first preset direction, and the plurality of air guide plates are arranged in sequence along a direction from the third side to the fourth side.

16. A portable fan, comprising:

a housing body, wherein the housing body is provided with an accommodating chamber, an air inlet, and an air outlet; the air outlet, at least part of the accommodating chamber and the air inlet are communicated to each other in sequence along a first preset direction;

a fan assembly, wherein the fan assembly is located within the accommodating chamber and between the air inlet and the air outlet, and is configured to drive an air flow to flow from the air inlet to the air outlet;

a power supply assembly, wherein the power supply assembly is located within the accommodating chamber, the power supply assembly is offset from a projection of the fan assembly along the first preset direction, and the power supply assembly is electrically connected to the fan assembly to supply power to the fan assembly; and a first clamping device, wherein the first clamping device is connected to one side of the housing body, and is configured to form a clamping space with the housing body for clamping an external object, so as to fix the portable fan onto the external object;

wherein the housing body comprises a housing and a mounting shell located within the housing; the mounting shell comprises a partition plate, and the fan assembly and the power supply assembly are respectively positioned on two sides of the partition plate; the first clamping device is connected to the mounting shell and is integrally formed with the mounting shell; the housing is provided with a clamping slot, and a part of the first clamping device connecting to the mounting shell is fixed within the clamping slot.

17. The portable fan according to claim 16, wherein the power supply assembly comprises a battery; the mounting shell further comprises at least one limiting and fixing member connected to the partition plate and extending towards the battery, and the at least one limiting and fixing member is arranged around a periphery of the battery to fix the battery; the portable fan further comprises a control assembly, the control assembly is located within the accommodating chamber, and the control assembly comprises a control button and a circuit board electrically connected to the control button and the battery; the third side of the housing body is provided with a button hole, and the control button is arranged corresponding to the button hole.

18. A fan assembly, comprising:

a fan shell;

a motor; and a fan blade connected to the motor, wherein the fan blade is arranged within the fan shell; the fan shell comprises a shell main body, an air outlet hood, and a grille; the air outlet hood is arranged on one side of the shell main body and has a plurality of air outlet holes, the grille is arranged on the other side of the shell main body, and the grille comprises a plurality of air inlet holes for reducing wind resistance and increasing air intake volume; the air outlet hood comprises a plurality of air gathering rings and an annular wall structure connected to a periphery of the plurality of air gathering rings; a plurality of air outlet holes are defined among the plurality of air gathering rings, and the air gathering rings are configured to cooperate with an inner side surface of the annular wall structure to pressurize wind from the shell main body and then blow it out of the fan shell; and the inner side surface of the annular wall structure is an inclined surface or an arc-shaped surface, so that an inner diameter of the annular wall structure gradually decreases along a first preset direction, wherein the shell main body comprises a cylindrical arranged sidewall structure, a mounting part located at one end inside the sidewall structure and an air guide part connected between the mounting part and the sidewall structure, the air guide part comprises a plurality of air guide blades arranged at intervals and is configured to guide wind from the fan blade based on the first preset direction, the fan blade and the motor are arranged within the sidewall structure on one side of the mounting part, and the motor is mounted on the mounting part; the mounting part is provided with an opening, a conducting wire connected to the motor passes through the opening and then extends from a gap between the shell main body and the air outlet hood to be connected with a control assembly.

19. The fan assembly according to claim 18, wherein the grille is provided with a plurality of air inlet holes, and an inner diameter of each air inlet hole ranges from 0.5 mm to 4 mm.

* * * * *